US009897932B2

(12) United States Patent
Hotta et al.

(10) Patent No.: US 9,897,932 B2
(45) Date of Patent: Feb. 20, 2018

(54) TONER

(71) Applicant: CANON KABUSHIKI KAISHA, Tokyo (JP)

(72) Inventors: Yojiro Hotta, Mishima (JP); Kazuo Terauchi, Numazu (JP); Tsuneyoshi Tominaga, Suntou-gun (JP); Akane Masumoto, Yokohama (JP); Takuya Mizuguchi, Suntou-gun (JP); Motohide Shiozawa, Mishima (JP); Takeshi Naka, Suntou-gun (JP); Masami Fujimoto, Suntou-gun (JP); Shingo Ito, Tokyo (JP); Kousuke Yamamoto, Yokohama (JP); Yasukazu Ikami, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/420,651

(22) Filed: Jan. 31, 2017

(65) Prior Publication Data

US 2017/0227864 A1 Aug. 10, 2017

(30) Foreign Application Priority Data

Feb. 4, 2016 (JP) ..... 2016-019418

(51) Int. Cl.
*G03G 9/08* (2006.01)
*G03G 9/087* (2006.01)

(52) U.S. Cl.
CPC ..... *G03G 9/0825* (2013.01); *G03G 9/0819* (2013.01); *G03G 9/08755* (2013.01)

(58) Field of Classification Search
CPC ..... G03G 9/0825; G03G 9/0827
See application file for complete search history.

(56) References Cited

U.S. PATENT DOCUMENTS 5,354,637 A 10/1994 Shimamura et al.
5,406,357 A 4/1995 Nakahura et al.
(Continued)

FOREIGN PATENT DOCUMENTS

JP 2002-003213 1/2002
JP 2009-198983 9/2009
(Continued)

OTHER PUBLICATIONS

U.S. Appl. No. 15/415,397, filed Jan. 25, 2017, Sara Yoshida.

*Primary Examiner* — Hoa V Le
(74) *Attorney, Agent, or Firm* — Fitzpatrick Cella Harper and Scinto

(57) ABSTRACT

A toner comprising: a toner particle containing a toner base particle containing a binder resin and a colorant, and a resin particle fixed to a surface of the toner base particle; and an inorganic fine particle A, wherein the surface of the toner particle has protruded portions originating in the resin particle, an average length (D) of long sides of the protruded portions is 50 nm to 300 nm, an average Height (H) of the protruded portions is 25 nm to 250 nm, the average long-side length and the average height of the protruded portions satisfies a specific relationship, and an average value of a compactness of the inorganic fine particle A is 0.40 to 0.80, and the attachment rate of the inorganic fine particles A is 0.1% to 5.0% by area.

5 Claims, 3 Drawing Sheets

(56) References Cited

U.S. PATENT DOCUMENTS

| | | | |
|---|---|---|---|
| 5,415,967 | A | 5/1995 | Sakashita et al. |
| 5,436,701 | A | 7/1995 | Shimojo et al. |
| 5,447,813 | A | 9/1995 | Hagiwara et al. |
| 5,547,796 | A | 8/1996 | Kohtaki et al. |
| 5,716,746 | A | 2/1998 | Mikuriya et al. |
| 5,968,701 | A | 10/1999 | Onuma et al. |
| 6,020,102 | A | 2/2000 | Fujimoto et al. |
| 6,120,961 | A | 9/2000 | Tanikawa et al. |
| 6,156,471 | A | 12/2000 | Kobori et al. |
| 6,187,496 | B1 | 2/2001 | Tanikawa et al. |
| 6,203,959 | B1 | 3/2001 | Tanikawa et al. |
| 6,235,441 | B1 | 5/2001 | Tanikawa et al. |
| 6,495,303 | B1 | 12/2002 | Kanda et al. |
| 6,528,222 | B2 | 3/2003 | Kohtaki et al. |
| 6,586,147 | B2 | 7/2003 | Iida et al. |
| 6,630,277 | B2 | 10/2003 | Naka et al. |
| 6,653,036 | B1 | 11/2003 | Tanikawa et al. |
| 6,670,087 | B2 | 12/2003 | Fujikawa et al. |
| 6,703,176 | B2 | 3/2004 | Naka et al. |
| 6,751,424 | B2 | 6/2004 | Komatsu et al. |
| 6,808,852 | B2 | 10/2004 | Hotta et al. |
| 6,929,894 | B2 | 8/2005 | Sugahara et al. |
| 7,115,349 | B2 | 10/2006 | Iida et al. |
| 7,138,213 | B2 | 11/2006 | Itakura et al. |
| 7,144,668 | B2 | 12/2006 | Baba et al. |
| 7,147,980 | B2 | 12/2006 | Itakura et al. |
| 7,147,981 | B2 | 12/2006 | Fujikawa et al. |
| 7,244,539 | B2 | 7/2007 | Baba et al. |
| 7,455,947 | B2 | 11/2008 | Ida et al. |
| 7,537,877 | B2 | 5/2009 | Yoshiba et al. |
| 7,611,813 | B2 | 11/2009 | Ida et al. |
| 7,629,100 | B2 | 12/2009 | Okamoto et al. |
| 7,700,254 | B2 | 4/2010 | Moribe et al. |
| 7,740,998 | B2 | 6/2010 | Yamazaki et al. |
| 7,767,370 | B2 | 8/2010 | Ishigami et al. |
| 7,816,063 | B2 | 10/2010 | Tanikawa et al. |
| 7,855,042 | B2 | 12/2010 | Kobori et al. |
| 7,897,316 | B2 | 5/2011 | Yamazaki et al. |
| 8,057,977 | B2 | 11/2011 | Moribe et al. |
| 8,142,972 | B2 | 3/2012 | Hotta et al. |
| 8,293,447 | B2 | 10/2012 | Yamazaki et al. |
| 8,323,726 | B2 | 12/2012 | Naka et al. |
| 8,372,573 | B2 | 2/2013 | Ayaki et al. |
| 8,383,313 | B2 | 2/2013 | Ayaki et al. |
| 8,501,377 | B2 | 8/2013 | Takahashi et al. |
| 8,512,925 | B2 | 8/2013 | Moribe et al. |
| 8,518,625 | B2 | 8/2013 | Fukao et al. |
| 8,551,680 | B2 | 10/2013 | Ayaki et al. |
| 8,574,801 | B2 | 11/2013 | Itabashi et al. |
| 8,609,312 | B2 | 12/2013 | Itabashi et al. |
| 8,614,040 | B2 | 12/2013 | Fukao et al. |
| 8,927,188 | B2 | 1/2015 | Naka et al. |
| 9,029,056 | B2 | 5/2015 | Kenmoku et al. |
| 9,040,216 | B2 | 5/2015 | Fukudome et al. |
| 9,046,800 | B2 | 6/2015 | Hotta et al. |
| 9,097,998 | B2 | 8/2015 | Yamazaki et al. |
| 9,098,002 | B2 | 8/2015 | Kenmoku et al. |
| 9,098,003 | B2 | 8/2015 | Masumoto et al. |
| 9,116,448 | B2 | 8/2015 | Terauchi et al. |
| 9,128,400 | B2 | 9/2015 | Takahashi et al. |
| 9,134,637 | B2 | 9/2015 | Hotta et al. |
| 9,141,012 | B2 | 9/2015 | Moribe et al. |
| 9,201,323 | B2 | 12/2015 | Nishikawa et al. |
| 9,250,548 | B2 | 2/2016 | Nomura et al. |
| 9,261,804 | B2 | 2/2016 | Yamazaki et al. |
| 9,341,970 | B2 | 5/2016 | Yoshiba et al. |
| 9,423,708 | B2 | 8/2016 | Tominaga et al. |
| 9,575,425 | B2 | 2/2017 | Naka et al. |
| 2011/0089085 | A1 | 4/2011 | Tamura et al. |
| 2011/0250533 | A1* | 10/2011 | Kadota ..... G03G 9/0804 430/105 |
| 2012/0214097 | A1 | 8/2012 | Naka et al. |
| 2012/0219321 | A1* | 8/2012 | Fukao ..... G03G 9/0827 399/111 |
| 2012/0237267 | A1* | 9/2012 | Fukao ..... B82Y 30/00 399/252 |
| 2013/0065174 | A1 | 3/2013 | Itabashi et al. |
| 2013/0252167 | A1 | 9/2013 | Moribe et al. |
| 2013/0309603 | A1 | 11/2013 | Takahashi et al. |
| 2014/0004460 | A1 | 1/2014 | Yoshiba et al. |
| 2014/0038095 | A1* | 2/2014 | Ishikawa ..... G03G 9/0819 430/105 |
| 2014/0050504 | A1* | 2/2014 | Fukao ..... G03G 9/0827 399/111 |
| 2014/0356774 | A1* | 12/2014 | Miki ..... G03G 9/0935 430/105 |
| 2015/0099220 | A1 | 4/2015 | Abe et al. |
| 2015/0125790 | A1 | 5/2015 | Hotta et al. |
| 2015/0220013 | A1 | 8/2015 | Nishikawa et al. |
| 2015/0286157 | A1 | 10/2015 | Masumoto et al. |
| 2015/0331344 | A1 | 11/2015 | Tominaga et al. |
| 2016/0041482 | A1 | 2/2016 | Terauchi et al. |
| 2016/0041484 | A1 | 2/2016 | Tsuda et al. |
| 2016/0070192 | A1 | 3/2016 | Terauchi et al. |
| 2016/0091809 | A1 | 3/2016 | Tsuda et al. |
| 2016/0091813 | A1 | 3/2016 | Yoshiba et al. |
| 2016/0161874 | A1 | 6/2016 | Yamazaki et al. |
| 2016/0202624 | A1 | 7/2016 | Nishikawa et al. |
| 2016/0299446 | A1 | 10/2016 | Kuroki et al. |
| 2016/0299447 | A1 | 10/2016 | Masumoto et al. |

FOREIGN PATENT DOCUMENTS

| | | |
|---|---|---|
| JP | 2012-008555 | 1/2012 |
| JP | 2012-208492 | 10/2012 |
| JP | 2013-064826 | 4/2013 |

* cited by examiner

TONER

BACKGROUND OF THE INVENTION

Field of the Invention

The present Invention relates to a toner for use in an image-forming method for developing electrophotographic end electrostatic images.

Description of the Related Art

In a common electrophotographic method, a latent image is formed on an image-bearing member (photoreceptor drum), toner is supplied to the latent image to obtain a visible image, and the toner image is transferred to paper or another transfer material and then fixed by heat or pressure on the transfer material to obtain a copied article. Printers using a high-speed one-component developing system have been used to satisfy demands for smaller alia, higher speeds and greater stability. Because the toner and the charging water contact each other less in a one component developing system than in a two-component developing system using a carrier, a relatively large stress must be applied to the toner to obtain the charge quantity, and consequently the load applied to the toner is known to be high.

For the toner used in a one-component developing system, a spherical toner with a sharp particle size distribution is desirable because it provides excellent transferability and fine line reproducibility among other features. However, in system in which the toner is cleaned from the photoreceptor drum with a cleaning blade, cleaning becomes more difficult the greater the circularity of the toner. One reason for this is thought to be that a high degree of circularity causes the toner to roll, making it more likely to slip through the contact nip between the cleaning blade and the photoreceptor.

One strategy chat has been adopted for preventing faulty cleaning with a conventional spherical toner is to increase the linear pressure applied to the edge of the blade in a blade-type cleaning system, thus preventing the spherical toner from slipping through. However, simply increasing the linear pressure nay lead to such problems as increased cracking of the blade edge, abnormal noise caused by blade chatter vibration, and increased wear to the photoreceptor due to contact with the blade. Thus, toner cleaning performance must be improved without relying solely on linear pressure in order to meet future needs for higher speeds and longer operating lives.

To this end, Japanese Patent Application Publication No. 2012-208492 proposes a toner with improved functionality obtained by fixing a resin particle with various additional functions to the surface of a toner base particle.

Japanese Patent Application Publication No. 2012-8555 proposes a toner wherein the attachment force of the toner has been reduced by keeping the embedding ratio of a resin particle within a specific range.

SUMMARY OF THE INVENTION

However, in the method of Japanese Patent Application Publication No. 2012-208492 the resin particles are embedded, and the reduction in attachment force with the photoreceptor drum is inadequate due to the presence of protrusions, resulting in an insufficient cleaning performance. In Japanese Patent Application Publication No. 2013-8555, simply reducing the attachment force of the toner is not sufficient for improving the cleaning performance of the spherical toner, so when designing the toner it is necessary to also consider blocking the toner by causing an external additive to accumulate and form a layer on the cleaning blade edge.

Conventionally, improvements to the cleaning performance of toners have been dependent on the contact pressure of the cleaning blade, but as operating lives have increased the likelihood of blade cracks, photoreceptor drum wear and blade chatter vibration has increased. Faulty cleaning can occur as a result.

It is an object of the present invention to provide a toner that solves these problems. That is, a toner is provided that has good cleaning performance in systems with long operating lives, as well as good charging performance, and that yields very fine images.

The inventors discovered that by controlling the surface shape of the toner particle and controlling attachment of external additives to the photoreceptor drum, it is possible to improve the ease of removal of the toner from the photoreceptor drum, and improve the cleaning performance by facilitating the formation of a layer that blocks the toner. The inventors also discovered that by controlling the surface shape of the toner particles, it is possible to obtain good charging performance and produce very fine images with few development streaks and other image defects.

The present invention is a toner including a toner particle containing a toner bass particle containing a binder resin and a colorant, and a resin particle fixed to a surface of the toner base particle; and an inorganic fine particle A and, wherein the surface of the toner particle has protruded portions originating In the resin particle, an average length (D) of long sides of the protruded portions is from 50 nm to 300 nm, an average height (H) of the protruded portions is from 25 nm to 250 nm.

a relationship between the average long-side length and the average height of the protruded portions satisfies the following formula (1), and an average value of compactness of the inorganic fine particle A observed under a scanning electron microscope (SEM) as represented by formula (2) below is from 0.10 to 0.80, and an attachment race of the inorganic fine particles A with a compactness of from 0.40 to 0.80 is from 0.1% to 5.0% by area according to polycarbonate thin film attachment measurement of the toner:

$$0.50\ D \leq H \leq 0.80\ D \qquad \text{Formula (1)}$$

Compactness–area of inorganic fine particle/area of region enclosed by envelope of inorganic fine particle Formula (2).

With the present invention it is possible to provide a toner that has good cleaning performance in systems with long operating lives, an well an good charging performance, and that yields very fine images.

Further features of the present invention will become apparent from the following description of exemplary embodiments (with reference to the attached drawings).

DESCRIPTION OF THE EMBODIMENTS

Figure 1:
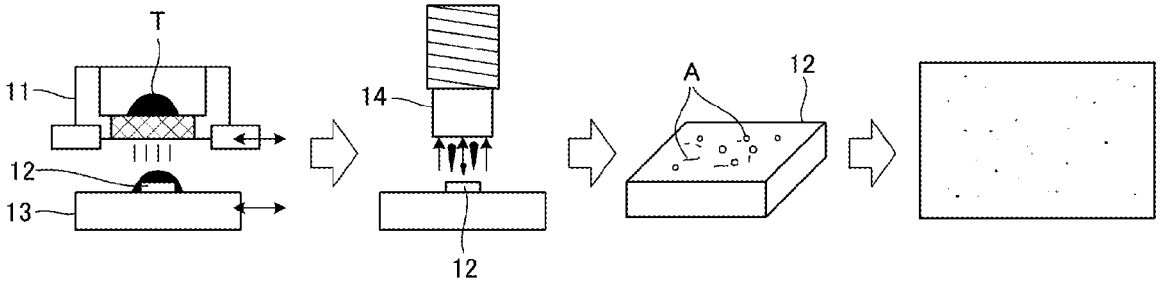
FIG. 1 is an outline of a polycarbonate thin film attachment measurement method.

Unless otherwise specified, numerical ranges such as "from A to B" or "A-B" in the present invention include the minimum and maximum values at either end of the range.

The present invention is explained in detail below.

In multi-sheet copying operations in a conventional one-component developing system, the toner is compressed by stress between the developer carrying member and the developer regulating blade or between the developer carrying member and the photoreceptor drum, and fluidity is reduced due to embedding of external additives. As the toner deteriorates, the attachment force of the toner increases, and toner is likely to be retained between the developer carrying member and the regulating blade. As a result, toner melt adhesion occurs due to frictional heat between toner particles or between the toner and the member, and image streaks and other problems may occur as a result.

The present invention is a toner containing on inorganic fine particle A and a toner particle comprising a toner base particle containing a binder resin and a colorant, with a resin particle fixed to the surface of this toner base particle, wherein the surface of the toner base particle necessarily has protruded portions originating in the resin particle.

It has been discovered from an analysis of the cleaning the entry rate of the toner into the cleaning part can be reduced and the cleaning performance improved by fixing a resin particle on the surface of a toner base particle, thereby giving the protruded portions (projections) the shape of the present invention. The details are not entirely clear, but are considered to be as follows.

During image formation, a latent image is formed on the photoreceptor drum, toner is supplied to the latent image to produce a visible image, and the toner image is transferred to paper or another transfer material, after which any untransferred toner is cleaned. Toner that has become electrostatically attached to the photoreceptor drum is scraped off with a cleaning blade, thereby cleaning the photoreceptor drum. The electrostatic attachment force can be reduced by giving the protruded portions on the toner particle surface, which cause the toner to slide on the photoreceptor drum.

Moreover, when the toner has become compacted on the cleaning part, the protruded portion (projections) on the surface of the toner particle cause the toner particles to catch on each other, thereby controlling toner rolling. It is thought that the entry rate of the toner into the cleaning part is reduced by these two factors. Slippage of toner from the cleaning blade is controlled and cleaning performance is improved as a result.

As a result of exhaustive research aimed at obtaining such effects, the inventors discovered that it was necessary to form protruded portions by fixing resin particles as described below as protruded portions (projections) on the toner particle surface. Although larger protruded portions are desirable for causing the toner to slide on the cleaning part and causing the particles to catch on each other, the toner needs to pass between the developer carrying member and the developer regulating blade in a one-component developing system. If the protruded portions are too large, it becomes more difficult for the toner to pass between the developer carrying member and the developer regulating blade, while if the protruded portions are too small the sliding effect and catching effect are reduced, detracting from the cleaning performance. Therefore, the protruded portions are necessarily as follows.

The average length (D) of the long sides of the protruded portions must be from 50 nm to 300 nm, the average height (H) of the protruded portions must the from 25 nm to 250 nm, and the relationship between the average long-side length and average height of the protruded portions must Satisfy the following Formula (1):

$$0.50\ D \leq H \leq 0.80\ D \qquad \text{Formula (1)}$$

Both charging stability during development and cleaning performance can be achieved if the protruded portions on the surface of the toner particle are as described above. If the average long-side length (D) of the protruded portions is less than 50 nm, the effect of the protruded portions on sliding between the toner and photoreceptor drum will fee less, there will be less reduction in the attachment force of the toner, and the effect on cleaning will be less, if the average long-side length (D) of the protruded portions is more than 300 nm, the contact area between the photoreceptor drum and the toner will increase, there will be less reduction in tile attachment force of the toner, and the effect on cleaning will be less.

The average long-side length (D) of the protruded portions is preferably from 50 nm to 250 nm, or more preferably from 70 nm to 200 nm. The average long-side length (D) of the protruded portions can be controlled by controlling the particle diameter of the resin particles and the resin particle fixing conditions (temperature, time).

If the average height (H) of the protruded portions is less than 25 nm, there will be less reduction in the attachment force of the toner and the effect on cleaning will be less because the resin particles are too embedded in the toner. If the average height (H) of the protruded portions is more than 250 nm, on the other hand, the toner particles will catch too strongly on each other. This detracts from the fluidity of the toner, making image defects more likely.

The average height (H) of the protruded portions is preferably from 35 nm to 200 nm, or more preferably from 35 nm to 70 nm. The average height (H) of the protruded portions can be controlled by Controlling the particle diameter of the resin particles and the resin particle fixing conditions (temperature, time).

To achieve the effects of reduction in the attachment force of the toner and catching between toner particles, the average long-side length (D) of the protruded portions must also be controlled relative to the average height (H) of the protruded portions as shown by Formula (1). If H is less than 0.50 D, the contact area between the photoreceptor drum and the toner increases, because the resin particles are too embedded, and the effect on cleaning is less because the catching effect between toner particles, is reduced. If H is greater than 0.80 D, on the other hand, fluidity is reduced because there is too much catching between toner, particle, leading to scratches and the like on the photoreceptor drum and detracting from cleaning performance.

The average height (H) of the protruded portions is preferably from 0.54 D to 0.75 D, or more preferably from 0.54 D to 0.60 D.

An investigation of external additives added to toner particles with such protruded portions revealed that with conventional external additives, fogging is unsatisfactory in high-temperature, high-humidity environments using systems with long operating lives. The inventors discovered as a result of an investigation focusing oh the shape of external additives that it is important to keep the compactness of in external additive within a specific range.

Compactness is the measure shown by Formula (2) below, which represents the area of an inorganic fine particle divided by the convex area of the inorganic fine particle. The convex area is the area of the part enclosed by an envelope prepared based on the contour of the external additive in question. Compactness assumes a value between 0 and 1, with smaller values representing complicated shapes with many depressed portions. The toner of the present invention necessarily contains an inorganic fine particle A having a shape with an average compactness value of from 0.40 to 0.80.

Compactness=area of inorganic fine particle/area of region enclosed by envelope of inorganic fine particle Formula (2)

By using an inorganic fine particle A with a value within this numerical range with a toner particle having protruded portions, it is possible to improve fogging and cleaning performance in high-temperature, high-humidity environments, and stably obtain very fine images.

The reason for this is believed to be as follows. In a one-component developing system, the toner acquires a charge as a result of passing between the developer carrying member and the developer regulating blade. The toner can acquire a uniform charge if it passes through without being retained in this space. Using an inorganic fine particle A with a specific range of compactness with a toner particle having protruded portions makes it easier for the depressed portions of the inorganic fine particle A to catch on the protruded portions of the toner particle.

This serves to moderate catching between toner particles with protruded portions in the developing part, and to reduce retention of toner between the developer carrying member and the developer regulating blade. Thus, even after multi-sheet copying operations the charge distribution of the toner remains uniform, and fogging of the white portions of the image is less likely as a result.

If the average value of the compactness of the inorganic fine particle A is less than 0.40, catching with the protruded portion of the toner particle will be unsatisfactory due to the presence of too many fine depressed portions. If the average value of the compactness of the inorganic fine particle A is over 0.80, on the other hand, catching with the protruded portions of the toner particle will also be unsatisfactory because there are too few depressed portions.

It was also discovered that an inorganic fine particle A with a specific range of compactness also has an effect on cleaning performance. To stably maintain cleaning performance, it is not enough to simply control the shape of the protruded portions on the toner particle surface; it is also necessary to design the toner so that the external additive accumulates on the cleaning blade edge to form a layer which blocks the toner.

It is not clear exactly how the effect of the inorganic fine particle A with a specific range of compactness is achieved, but it may be as follows. If the inorganic fine particles have many depressed portions, they are likely to catch, on each other and less likely to roll, so there is no particle rotation even in the cleaning nip. The inorganic fine particles are thus likely to accumulate in the nip, forming a stable toner blocking layer.

To maximize the effect of this inorganic fine particle A, the inorganic fine particle must be used with a toner particle having protruded portions. When protruded portions are present on the surface of the toner particle, the depressed portions of the inorganic fine particle A catch on these protruded portions, so that inorganic fine particles A are present on the outer surface of the toner. These inorganic fine particles A are thus likely to move to the photoreceptor drum when the toner is attached to the photoreceptor drum. This makes it easy for the inorganic fine particles A to form a layer that blacks the toner, and means that the particles are more likely to affect cleaning performance.

The average value of the compactness of the inorganic fine particle A is preferably from 0.50 to 0.80, or more preferably from 0.60 to 0.75. The compactness of the inorganic fine particle A can be controlled by varying the inorganic fine particle manufacturing process, the manufacturing process conditions or the like.

Aspect ratio has conventionally been used as an indicator of the shape of the external additive, but this has not been sufficiently represented the effect described above. This is because aspect ratio simply indicates slenderness, but a long, slender shape does not cause inorganic fine particles to catch on one another.

It was discovered that when such an inorganic fine particle A is applied to a toner particle with protruded portions, the inorganic fine particle A can be supplied effectively to the cleaning nip part. To obtain the effect of catching between inorganic fine particles in the cleaning nip part, it is necessary that inorganic fine particles with many depressed portions move from the toner and become attached to the photoreceptor drum surface. The inventors discovered as a result of exhaustive research that the degree of attachment could be measured by depositing toner on the surface of a polycarbonate thin film, suctioning away the toner, and then observing the polycarbonate thin film surface under a scanning electron microscope (SEM). The specific measurement methods are described below.

Polycarbonate Thin Film Attachment Measurement Method

The steps in the polycarbonate thin film attachment measurement method are shown in FIG. 1. In FIG. 1, a screen 11 made of 75 μm stainless steel mesh is used to dispose a toner T on a substrate 12. To model the surface layer, of the photoreceptor, the substrate was obtained by laminating polycarbonate (Iupilon Z-400, Mitsubishi Engineering-Plastics Corporation, viscosity-average molecular weight (Mv) 40,000) Onto a 50 μm-thick aluminum sheet. First, the polycarbonate was dissolved to 10 mass % in toluene to obtain a coating solution. This coating solution was coated on the aluminum sheet with a 50th Mayer bar, and dried for 10 minutes at 100° C. to prepare a sheet with a polycarbonate film thickness of 10 μm on an aluminum sheet. This sheet was held by substrate holder 13.

The substrate had a roughly 3 mm square shape. About 10 mg of toner was loaded into the screen, and the substrate was disposed directly below the screen at a distance of 20 mm. The screen opening was 10 mm in diameter so that the toner would be efficiently deposited from the screen onto the substrate.

A sawtooth waveform oscillation with an amplitude of 1 mm and a duty ratio of 33% (corresponding to 5 G acceleration) was applied at 5 Hz for 30 seconds to the screen in the in-plane direction to deposit the toner on the substrate.

Step of Applying Oscillation to Substrate with Deposited Toner

Next, a sawtooth waveform oscillation with an amplitude of 1 mm and a duty ratio of 33% (corresponding to 0.5 G acceleration) was applied at 3 Hz for 20 seconds to the substrate with the deposited toner in the in-plane direction to promote contact between the substrate and the toner.

Step of Removing Toner from Substrate

Following application of oscillation, an elastomer suction port with a bore of about 5 mm connected to the nozzle end of a vacuum cleaner was used as suction means 14 and brought close to the surface of the substrate with the deposited toner in the perpendicular direction, and the toner attached to the substrate was removed. The residual toner was confirmed visually during the removal step. In this embodiment, the distance between the suction port end and the substrate was about 1 mm, and the suction time was about 3 seconds. The measured value of the suction pressure at this time was 6 kPa.

Step of Quantifying Attached Amount of Inorganic Fine Particles Supplied to Substrate.

Scanning electron microscope observation and image measurement were used to obtain numerical values for the amount and shape of the inorganic fine particles remaining on the substrate after removal of the toner. Following toner removal, Pt was sputtered onto the substrate for 60 seconds at 20 mA current to obtain an observation sample. Next, any magnification at which roughly 100 nm inorganic fine particles can be observed can be selected for the scanning electron microscope observation. Using a Hitachi S-4800 Ultra-High Resolution Field Emission Scanning Electron Microscope (Hitachi High-Technologies Corporation), S-4800 backscattered electron images were observed. The magnification depends on the diameter of the inorganic the particles, but for example with roughly 100 nm particles observation can be performed at magnification 20000 with an accelerating voltage of 10 kV and an operating distance of 3 mm. The observed area at magnification 20000 is about 30 μm by 20 μm.

Figure 2:
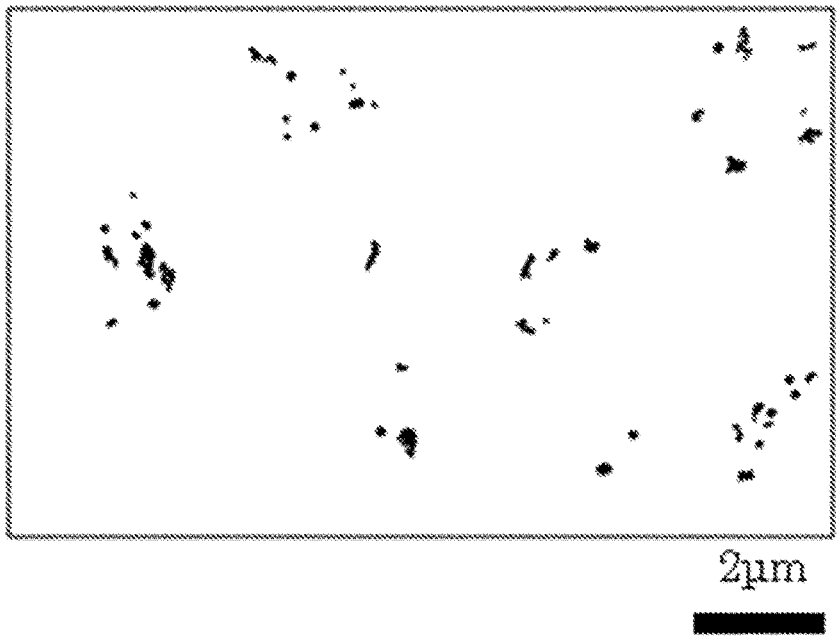
FIG. 2 is one example of a binarized image used to quantify the shape of an external additive.

Because the inorganic fine particles appear with high brightness and the substrate appears with low brightness in the images obtained by observation, the amount of inorganic fine particles in the visual field can be quantified by binarization. The binarization conditions can be selected appropriately according to the observation equipment and sputtering conditions. In this case, using Image J image analysis software (developed by Wayne Rasband) for binarization, the background brightness distribution was removed with a flattening, radius of 40 pixels from the Subtract Background menu, after which binarization was performed with a brightness threshold of 50. FIG. 2 shows an example of a resulting binarized image.

The attached amount of inorganic fine particles was calculated from the resulting binarized image by particle analysis using Image J image analysis software. To calculate the attached amount, the area and shape were determined from the particles in the binarized image.

The area of the particles is a value extracted by using image analysis software to specify those particles from 0.005 $\mu m^2$ to 0.100 $\mu m^2$ in size with a compactness of from 0.40 to 0.80 out of the inorganic fine particles with high brightness in the observed area. Compactness here is a value represented by Formula (2) below, calculated from the area of the inorganic fine particle and the area of region enclosed by envelope of inorganic fine particle. Compactness can be specified as a numerical range under "Solidity" in the Image J image analysis software.

$$\text{Compactness} = \text{area of inorganic fine particle} / \text{area of region enclosed by envelope of inorganic fine particle} \quad \text{Formula (2)}$$

Given 100% as the observed area of the polycarbonate thin film, the area of the particles whose area and shape have been determined and calculated from the particles in the binarized image is given as the inorganic fine particle area ratio, which is the ratio of area of the inorganic fine-particles relative to the entire visual field. This measurement was performed on 100 binarized images, and the average value given as the attached amount of the inorganic fine particles A.

In polycarbonate thin film attachment measurement of the toner of the invention, the attached amount of the inorganic fine particles A with a compactness of from 0.40 to 0.80 must be in the range of from 0.1% to 5.0% by area, given 100% as the area of the polycarbonate thin film.

In the toner of the invention, protruded portions originating in the resin particles are formed on the toner particle surface. The inventors believe that with such a toner particle surface, an inorganic fine particle having depressed portions can be easily and effectively supplied to the cleaning part. In the external addition step, the inorganic fine particles having depressed portions attach to the toner particle by catching onto the protruded portions on the surface of the toner particles. When the toner then adheres to the photoreceptor drum, the inorganic fine particles with depressed portions are then likely to become attached to the photoreceptor drum.

If the attached amount of the inorganic fine particles A with a compactness of from 0.40 to 0.80 is less than 0.1% by area, fewer of the inorganic fine particles are supplied to the cleaning part, the toner blocking layer does not stabilize in the cleaning nip, and cleaning performance is reduced. On the other hand, if the adhering amount of the inorganic fine particles A with a compactness of from 0.40 to 0.80 is more than 5.0% by area, too many inorganic fine particles are supplied to the cleaning part, causing contamination of the charging roller and other members, and leading to image defects.

The attached amount of the inorganic fine particles A with a compactness of from 0.40 to 0.80 is preferably from 1.0% to 4.0% by area. The attached amount of the inorganic fine particles A can be controlled by controlling the type and added amount of the inorganic fine particle.

The average minimum Feret diameter of the inorganic fine particle A as observed by scanning electron microscopy (SEM) is preferably from 50 nm to 500 nm.

If the average minimum Feret diameter is 50 nm or more, the inorganic fine particles A are more easily attached to the photoreceptor drum. If the average minimum Feret diameter is 500 nm or less, the toner has good fluidity. The average minimum Feret diameter is more preferably from 50 nm to 300 nm, or still more preferably from 50 nm to 250 nm. The minimum Feret diameter can be controlled by varying the inorganic fine particle manufacturing conditions. For example, when the inorganic fine particles are silica fine particles obtained by gasifying silicon tetrachloride, the minimum Feret diameter can be changed by increasing the silica concentration or increasing the retention time.

From the standpoint of achieving a more effective toner sliding effect or catching effect between toner particles in the cleaning part, the resin particles should preferably be present as follows.

In four regions defined as follows in a backscattered electron image of the toner particle taken with a scanning electron microscope, the average abundance of the resin particles in each region is preferably from 5% to 40% by area, and the coefficient of variation of the number of resin particles as represented by Formula (3) below is preferably 1.5 or less. A coefficient of 1.5 or less means that the resin particles are in a more dispersed state, so that the catching effect between toner particles caused by the resin particles is more easily obtained, and because toner rolling can therefore be controlled, the entry rate of the toner into the cleaning part can be easily reduced and cleaning performance improved.

Definition of regions: In a backscattered electron image of the toner particle, the chord giving the maximum length is given as line segment A, and two straight lines parallel to and 1.5 μm distant from line segment A are given as line B and line C. A straight line passing through the center point of line segment A at a right angle is given as line D, and two straight lines parallel to and 1.5 μm distant from line D are given as line E and line F. The four square areas each having 1.5 μm sides formed by the line segment A and the lines B, C, D, E and F are defined as the four regions.

Coefficient of variation=(standard deviation of number of particles/average number of particles Formula (3)

The average abundance of the resin particles is more preferably from 10% to 30% by area. The average abundance of the resin particles can be controlled by controlling the added amount of the resin particles and the fixing conditions. The coefficient of variation of the number of resin particles is more preferably from 0.5 to 1.5. The coefficient of variation of the number of resin particles can be controlled by controlling the type of resin particles (composition and particle size distribution).

The median diameter (D50) of the resin particles as determined by laser scattering particle size distribution analysis is preferably from 50 nm to 300 nm, or more preferably from 80 nm to 200 nm.

A resin particle with a median diameter (D50) of 50 nm or more are easy to control because it becomes embedded to a suitable degree in the toner base particles when the resin particle is fixed to the toner base particles. Moreover, satisfactory fixing strength is obtained if the median diameter (D50) of the resin particle is 300 nm or less. The median diameter is a particle diameter defined as the 50% value (median cumulative value) of the cumulative curve of particle size distribution, and can be measured for example with a laser diffraction/scattering particle size distribution analyzer (LA-920) manufactured by Horiba, Ltd.

The median diameter (D50) of the resin particle can be controlled by varying the conditions during resin particle manufacture.

Moreover, in order to form the abovementioned protruded portions, given D10 as the 10% cumulative. diameter of the resin particles based oh volume, D90 as the 90% cumulative diameter of the resin particles based on volume, and D50 as the median diameter of the resin particles, the span value A as defined by the following formula is preferably from 0.9 to 2.0, or more preferably from 1.3 to 1.7.

Span value A (D90-D10)/D50 Formula (4)

A span value A within this range is desirable for effectively forming protruded portions on the surface of the toner particle. If the span value A is at or above the minimum value, there is a suitable degree of variation in the height of the protruded portions on the surface of the toner particle, which means that the attachment force between the toner and the photoreceptor drum is likely to be less, and the sliding effect of the toner on the photoreceptor drum is obtained more easily. If the span value A is at or below the maximum value, there is less likely to be variation in the height of the protruded portions formed by the resin particles or the coefficient of variation, and the catching effect between toner particles is improved.

In the present invention, the toner particle is not particularly limited as long as it comprises a toner core particle containing a binder resin and a colorant, together with a resin particle fixed to the surface of the toner core particle, and as long as it has specific protruded portions formed by the resin particle.

The protruded and depressed shapes specified by the invention are more easily formed on the toner particle surface using a resin particle having a specific pKa (acid dissociation constant). Specifically, the resin particle preferably contains a resin having ionic functional groups and a pKa (acid dissociation constant) of 6.0 to 9.0.

Dissociation of the ionic functional groups in the resin can be easily controlled in an aqueous medium. Dissociation of the ionic functional groups in the resin generates a suitable repulsive force between the resin particles, making it possible to fix the resin particles on the surface of the toner core particle in a dispersed state. The pKa (acid dissociation constant) is more preferably from 7.0 to 8.5, or still more preferably from 7.0 to 8.0.

If the pKa (acid dissociation constant) is 6.0 or more, dissociation of ionic functional groups in the resin will not be excessive, repulsion between resin particles will not increase too much, and there is likely to be bias in the fixing of the particles on the surface of the toner core particle. If the pKa (acid dissociation constant) is 9.0 or less, on the other hand, the resin particles are less likely to aggregate because there is a suitable degree of dissociation of ionic functional groups in the aqueous medium.

The pKa (acid, dissociation constant) is determined as described below, and it can be determined from the neutralising titration results.

The resin having ionic functional groups may be any that fulfills the pKa (acid dissociation constant) requirement above.

For example, a resin having hydroxyl groups bound to an aromatic ring or carboxyl groups bound to an aromatic ring is desirable for keeping the pKa (acid dissociation constant) within the aforementioned range.

For example, a polymer containing one or more monomers selected from the group consisting of vinylsalicylic acid, monovinyl phthalate, vinylbenzoic acid and 1-vinylnaphthalene-2-carboxylic acid is desirable.

More preferably, the resin particle contains a polymer A having a monovalent group a represented by Formula (4) below.

(4)

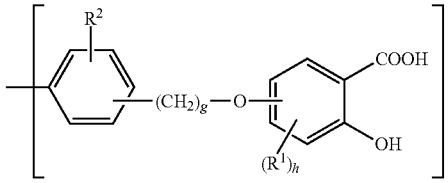

(In Formula (4) , each $R^1$ independently represents a hydroxyl group, carboxyl group, $C_{1-18}$ alkyl group or $C_{1-18}$ alkoxy group, $R^2$ represents a hydrogen atom, hydroxyl group, $C_{1-18}$ alkyl group or $C_{1-18}$ alkoxy group, g represents an integer from 1 to 3, and h represents an integer from 0 to 3.)

Examples of alkyl groups in $R^1$ and $R^2$ include methyl, ethyl, propyl, isopropyl, butyl, isobutyl, s-butyl and t-butyl groups, and examples of alkoxy groups include methoxy, ethoxy and propoxy groups.

The main chain structure of the polymer A is not particularly limited.

Examples include vinyl polymers, polyester polymers, polyamide polymers, polyurethane polymers, polyether polymers and the like. Other examples include hybrid polymers obtained by combining 2 or more of these. Of the examples given here, a vinyl polymer is preferred from the standpoint of adhesiveness with the toner core particle.

The polymer A can be synthesized using a monomer that is a compound having a vinyl or other polymerizable functional group in a substitution site of the group represented by Formula (4). In this case, the site represented by Formula (4) is represented by the following Formula (4-2).

(4-2)

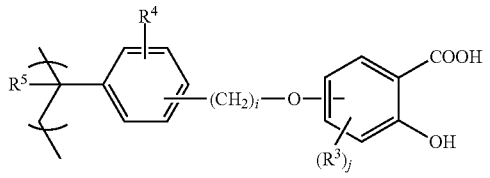

(In the Formula (4-2), each $R^3$ independently represents a $C_{1-18}$ (preferably $C_{1-4}$) alkyl group or $C_{1-18}$ (preferably $C_{1-4}$) alkoxy group. $R^4$ represents a Hydrogen atom, hydroxyl group, $C_{1-18}$ (preferably $C_{1-4}$) alkyl group or $C_{1-18}$ (preferably $C_{1-18}$ ) alkoxy group. $R^5$ represents a hydrogen atom or methyl group, i represents an integer from 1 to 3, and j represents an integer from 0 to 3.)

Methods are known for fixing resin particles to the surface of toner base particles, but because the resin particle is dispersed in a charged, state in an aqueous medium, a fixing method in which the pH of the aqueous medium is not less than the pKa. of the resin particle −2.0 is preferred. This method is preferred because the resin particle is thus fixed uniformly and strongly to the toner base particle, allowing the superior charging stability of the resin particle to be maintained long-term.

Dissociation of the ionic functional groups of the resin particle is dependent on the pH of the aqueous medium. It is thought that when the pH of the aqueous medium is low and there is little dissociation of ionic functional groups, many parts of the surface of the resin particles are not charged, and so the resin particles tend to contact one another and become fixed to the surfaces of the toner base particle in an aggregated state. Therefore, the pH of the aqueous medium is preferably not less than the pKa of the resin particle −2.0, making it easier to fix the resin particles while maintaining them in a dispersed state. More preferably, the pH of the aqueous medium is not less than the pKa of the resin particles.

To achieve a pH of the aqueous medium that is not less than the pKa of the resin particles −2.0, it is desirable to include a pH adjustment, step in which the pH of the aqueous medium is adjusted with a pH adjuster containing at least one selected from the group consisting of the acids with a pKa (acid dissociation constant) of 3.0 or less and the bases with a pKb (base dissociation constant) of 3.0 or less.

Examples of acids with a pKa (acid dissociation constant) of 3.0 or less include hydrochloric acid, bromic acid, iodic acid, perbromic acid, metaperiodic acid, permanganic acid, thiocyanic acid, sulfuric acid, nitric acid, phosphonic acid, phosphoric acid, diphosphoric acid, hexafluorophosphoric acid, tetrafluoroboric acid, tripolyphosphoric acid, aspartic acid, o-aminobenzoic acid, p-aminobenzoic acid, isonicotinic acid, oxaloacetic acid, citric acid, 2-glycerinephosphoric acid, glutamic acid, cyanoacetic acid, oxalic acid, trichloracetic acid, o-nitrobenzoic acid, nitroacetic acid, picric acid, picolinic acid, pyruvic acid, fumaric acid, fluoroacetic acid, bromoacetic acid, o-bromobenzoic acid, maleic acid, malonic acid and the like.

Of these, a monovalent acid is preferred for ease of pH adjustment. Of these, hydrochloric acid and nitric acid are particularly desirable.

Examples of bases with a pKb (base dissociation, constant) of 3.0 or less include lithium hydroxide, sodium hydroxide, potassium hydroxide, rubidium hydroxide, cesium hydroxide, tetamethylammonium hydroxide, tetraethylammonium hydroxide, calcium hydroxide, strontium hydroxide, barium hydroxide, magnesium hydroxide, europium hydroxide, thallium hydroxide, guanidine and the like.

Of these, a monovalent base is preferred for ease of dissociation of the ionic functional groups from the resin particles. In particular, lithium hydroxide, sodium hydroxide and potassium hydroxide are desirable.

A salt unrelated to pH adjustment may also be added, or an acid and a base may be used together.

The binder resin used in the toner of the invention is not particularly limited. For example, the following examples may be used: styrene resin, acrylic resin, methacrylic resin, styrene-acrylic resin, styrene-methacrylic resin, polyethylene resin, polyethylene-vinyl acetate resin, vinyl acetate resin, polybutadiene resin, phenol resin, polyurethane resin, polybutyral resin, polyester resin, or a hybrid resin obtained by binding any of these resins. Of these, the following are desirable from the standpoint of the toner characteristics: styrene resin, acrylic resin, methacrylic resin, styrene-acrylic resin, styrene-methacrylic resin, polyester resin, or a hybrid resin obtained by binding styrene-acrylic resin or styrene-methacrylic resin with polyester resin.

A common polyester resin manufactured using a polyvalent alcohol and a carboxylic acid (or carboxylic anhydride or carboxylic ester) as raw material monomers may be used as the polyester resin.

The toner of the invention may be used as a magnetic toner, and in this case the following magnetic materials may be used: iron oxides such as magnetite, maghemite and ferrite, or iron oxides containing other metal oxides; metals such as Fe, Co and Ni, alloys of these metals with metals such as Al, Co, Cu, Pb, Mg, Ni, Sn, Zn, Sb, Ca, Mn, Se and Ti, and mixtures of these; and triiron tetraoxide ($Fe_3O_4$), iron sesquioxide ($\gamma$-$Fe_2O_4$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$) and manganese iron oxide ($MnFe_2O_4$). These magnetic materials may be used individually, or two or more may be combined. A fine powder of $Fe_3O_4$ or $\gamma$-diiron trioxide ($Fe_2O_3$) is particularly desirable as a magnetic material.

The average particle diameter of these magnetic materials is preferably from 0.1 μm to 2 μm, or more preferably from 0.1 μm to 0.3 μm. In terms of the magnetic characteristics in a 795.8 kA/m (10 k oersted) field, the coercivity (Hc) is from 1.6 kA/m to 12 kA/m (20 oersteds to 150 oersteds), and the saturation magnetization ($\sigma s$) is from 5 $Am^2/kg$ to 200 $Am^2/kg$, or preferably from 50 $Am^3/kg$ to 100 $Am^2/kg$. The residual magnetization ($\sigma r$) is preferably from 2 $Am^2/kg$ to 20 $Am^2/kg$.

The magnetic body is used in the amount of preferably from 10.0 mass parts to 200.0 mass parts, or more preferably from 20.0 mass parts to 150.0 mass parts per 100 mass parts of the binder resin.

In the case of a non-magnetic toner, on the other hand, various conventionally known dyes, pigments and other known colorants may be used as colorants.

Examples of magenta color pigments include C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:1, 48:2, 48:3, 48:4, 48:5, 49, 50, 51, 52, 53, 54, 55, 57:1, 58, 60, 63, 64, 68, 81:1, 81:2, 81:3, 81:4, 81:5, 83, 87, 88, 89, 90, 112, 114, 122, 123, 146, 147, 150, 163, 184, 185, 202, 206, 207, 209, 238, 269, and 282; C.I. pigment violet 19; and C.I. vat red 1, 2, 10, 13, 15, 23, 29 and 35. These pigments may be used independently or a pigment may be used in combination with a dye.

Examples of cyan color pigments include copper phthalocyanine compounds and their derivatives, anthraquinone compounds, basic dye lake compounds and the like. Specific examples include C.I. pigment blue 1, 7, 15, 15:1, 15:2, 15:3, 15:4, 60, 62, 66 and the like.

Examples of yellow color pigments include condensed azo compounds, isoindolinone compounds, anthraquinone compounds, azo metal complexes, methine compounds, allylamide compounds and the like. Specific examples include C.I. pigment yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. vat yellow 1, 3 and 20.

Examples of black colorants include carbon black, aniline black, acetylene black, titanium black and black colorants obtained by blending the yellow, magenta and cyan colorants listed above.

The toner of the invention may also contain a release agent. Examples of release agents include aliphatic hydrocarbon waxes, such as low-molecular-weight polyethylene, low-molecular-weight polypropylene, microcrystalline wax and paraffin wax; oxides of aliphatic hydrocarbon wax such as oxidized polyethylene wax; block copolymers, of aliphatic hydrocarbon waxes; waxes composed primarily of fatty acid esters, such as carnauba wax, Sasol wax and montanic acid ester wax; partly or wholly of deacidifed fatty acid esters, such as deoxidized carnauba wax; partially esterified products of fatty acids and polyvalent alcohols, such as behenic acid monoglyceride; and methyl ester compounds having hydroxyl groups obtained by hydrogenation of vegetable oils and fats.

In the molecular weight distribution of the release agent, a main peak in the region of molecular weight of from 400 to 2400 is preferred, and one in the region of from 430 to 2000 is more preferred. This serves to give the toner superior thermal properties. The total added amount of the release agent is preferably from 2.50 mass parts to 40.0 mass parts or more preferably from 3.00 mass parts to 15.0 mass parts per 100 mass parts of the binder resin.

The method of manufacturing the toner particle is preferably a method having a dispersion solution preparation step in which a toner base particle is dispersed in an aqueous medium to obtain a dispersion solution of the toner base particle, a pH adjustment step, a resin particle addition step in which a resin particle is added to the aqueous medium, and a fixing step in that order. The resin particle can be uniformly fixed to the surface of the toner base particle in this way.

The dispersion solution preparation step is explained first.

The toner base particle may be manufactured by a conventional known method such as suspension polymerization, dissolution suspension, emulsion aggregation or pulverization. It is particularly desirable to manufacture the toner base particle by suspension polymerization. Suspension polymerization is explained below. If the toner base particle is manufactured in an aqueous medium it can be used as is in the next step, or the particle may be washed, filtered and dried and then re-dispersed in an aqueous medium. When the toner base particle is manufactured by a dry process, it can be dispersed by known methods in an aqueous medium. For purposes of dispersing the toner base particle in the aqueous medium, the aqueous medium preferably contains a dispersion stabilizer.

A known inorganic or organic dispersion stabilizer may be used as the dispersion stabilizer.

Examples of inorganic dispersion stabilizers include the following: calcium phosphate compounds, aluminum phosphate compounds, magnesium phosphate compounds, calcium hydroxide compounds, aluminum hydroxide compounds, magnesium hydroxide compounds, calcium carbonate compounds, aluminum carbonate compounds, magnesium carbonate compounds, calcium metasilicate compounds, calcium sulfate compounds, barium sulfate compounds, bentonite, silica and alumina.

Examples of organic dispersion stabilizers include the following: polyvinyl alcohol, gelatin, methyl cellulose, methyl hydroxypropyl cellulose, ethyl cellulose, carboxymethyl cellulose sodium salt, and starch.

In addition, a commercial nonionic, anionic or cationic surfactant may be used. Examples of such surfactants include the following: sodium dodecyl sulfate, sodium tetradecyl sulfate, sodium pentadecyl sulfate, sodium octyl sulfate, sodium oleate, sodium laurate, potassium stearate and calcium oleate.

Of these dispersion stabilizers, an inorganic dispersion stabilizer that is easily removable from the toner particle is preferred. Using an inorganic dispersion stabilizer as the dispersion stabilizer facilitates washing with an acid or base, so that very little of the stabilizer remains on the toner particle.

More preferably, the inorganic dispersion stabilizer is at least one selected from the group consisting of the calcium phosphate compounds, aluminum phosphate compounds, magnesium phosphate compounds, calcium hydroxide compounds, aluminum hydroxide compounds, magnesium hydroxide compounds, calcium carbonate compounds, aluminum carbonate compounds and magnesium carbonate compounds.

A commercial inorganic dispersion stabilizer may be used as is as the inorganic dispersion stabilizer. To obtain particles of an inorganic dispersion stabilizer having a fine, uniform particle size, the inorganic dispersion stabilizer may also be produced in an aqueous medium under high-speed agitation. For example, when a calcium phosphate compound is used as a dispersant, an aqueous sodium phosphate solution and an aqueous calcium chloride solution can be mixed under high-speed agitation to thereby form fine particles of a calcium phosphate compound.

The used amount of the dispersion stabilizer is preferably from 0.1 mass parts to 5.0 mass parts per 100.0 mass parts of the toner base particle.

The pH adjustment step is explained next.

The pH adjustment step is preferably performed before the resin particle addition step in which the resin particle is added to the aqueous medium. Aggregation between resin particles can be prevented by adjusting the pH of the aqueous medium before adding the resin particles to the aqueous medium.

The resin, particle addition step is explained next.

In the resin particle addition step, the resin particles are added as the dispersion solution of the toner base particle is being stirred. The temperature of the aqueous medium is preferably lower than the glass transition temperature of the resin particle in the resin particle addition step. This is because aggregation of the resin particles can be controlled at this temperature when the resin particles are added.

The fixing step is explained next.

The method of fixing the resin particles is preferably implemented with the pH of the aqueous medium at not less than the pKa of the resin particles −2.0. For example, after the resin particles are added to the dispersion solution of the toner base particles, they may be embedded in the base particles by mechanical impact force, or fixed by heating, the aqueous medium. Alternatively, a flocculant may be added to fix the resin particles, or a combination of these techniques may be used. The aqueous medium is preferably agitated in all of these cases.

More preferred is a technique in which the aqueous medium is heated to at or above the glass transition temperature of the toner base particle in order to strongly fix the resin particles to the toner base particle. With the aqueous medium at this temperature, the toner base particle become soft and the resin particles are fixed when they contact the toner base particles.

The zeta potential of the toner base particle is preferably at least 10 mV higher than the zeta potential of the resin particles in the fixing step. When the zeta potential of the toner base particle is at least 10 mV higher than the zeta potential of the resin particles, fixing can be accomplished in a short amount of time and variation in the toner can be controlled because the resin particles adhere electrostatically to the toner base particle.

The zeta potential of the toner base particle may be controlled using the dispersion stabilizer described above. Specifically, it may be controlled by controlling the type and amount of the dispersion stabilizer that is attached to the surface of the toner base particle, and the method of attachment.

After the resin particles have been fixed to the surface of the toner base particle, the product is filtered, washed and dried by known methods to obtain a toner particle. When an inorganic dispersion stabilizer has been used, it is preferably dissolved with an acid or base, and removed.

The resin particle can be prepared by any method. For example, a resin particle produced by a known method such as emulsion polymerization, soap-free emulsion polymerization, phase inversion emulsification or mechanical emulsification may be used. Of these methods, phase inversion emulsification is desirable because it easily yields a small-diameter resin particle without the need for an emulsifier or dispersion stabilizer.

Phase inversion emulsification uses a self-dispersible resin or a resin which can be made self-dispersible by neutralization. Self-dispersibility in an aqueous medium can be achieved with a resin having a hydrophilic group in the molecule. Specifically, good self-dispersibility is obtained with a resin having a polyether group or ionic functional group.

The resin particle is preferably manufactured using a resin that has an ionic functional group and becomes self-emulsifying when neutralized. Specifically, it is desirable to use a resin that has ionic functional groups and has a pKa (acid dissociation constant) of from 6.0 to 9.0.

Neutralization of the ionic functional groups in the resin enhances hydrophilicity and increases self-dispersibility in aqueous media. When this resin is dissolved in an organic solvent, a neutralizer is added, and the mixture is agitated and mixed with an aqueous medium, the solution of the resin undergoes phase inversion emulslfication to produce fine particles. Following phase inversion emulsification, the organic solvent is removed by a method such as heating or pressure reduction. In this way, a stable aqueous dispersion of the resin particle can be obtained by phase inversion emulsification without effectively using any emulsifier or dispersion stabilizer.

The content of the resin particle is preferably from 0.10 to 5.0 mass parts per 100 mass parts of the toner base particle. A content of at least 0.10 mass parts yields a toner particle with adequate durability and good charging performance due to fixing uniformity among toner particles. If the content is not more than 5.0 mass parts, good durability can be maintained while reducing image defects caused by excess resin particles. More preferably the content is from 0.20 mass parts to 3.0 mass parts.

A method for producing a toner base particle by suspension polymerization is explained below.

In this toner base particle manufacturing method, particles of a polymerizable monomer composition containing a polymerization monomer for forming a binder resin, a colorant, and other additives such as a release agent as necessary are formed in an aqueous medium, and the polymerizable monomer contained in the particles of the polymerizable monomer composition is polymerized to obtain a toner base particle.

First, a polymerizable monomer composition containing a polymerizable monomer and a colorant is added to an aqueous medium, and particles of the polymerizable monomer composition are formed in the aqueous medium. Specifically, a colorant is added to a polymerizable monomer that is the principal constituent material of the toner base particle, and these are uniformly dissolved or dispersed with a dispersing apparatus such a homogenizer, ball mill, colloid mill or ultrasonic disperser to prepare a polymerizable monomer composition. During this process, an additive such as a polyfunctional monomer, chain transfer agent, release agent, charge control agent, plasticizer or dispersant may be added appropriately to the polymerizable monomer composition as necessary.

Next, this polymerizable monomer composition is added to a previously-prepared aqueous medium containing the dispersion stabilizer, and is suspended using a high-speed dispersing apparatus such as a high-speed stirring blade or ultrasonic disperser to perform granulation. A polymerization initiator may be mixed with other additives when preparing the polymerizable monomer composition, or may be mixed with the polymerizable monomer composition immediately before the composition is suspended in the aqueous medium. Alternatively, the initiator may be dissolved in the polymerizable monomer or another solvent as necessary, and added during granulation or immediately after completion of granulation, or in other words immediately before the polymerization reaction.

Particles of a polymerizable monomer composition are formed in an aqueous medium in this way.

Next, the suspension of the dispersed particles of the polymerizable monomer composition is heated to preferably from 50° C. to 90° C., and a polymerization reaction is performed with agitation with the particles of the polymerizable monomer composition maintained in a particle state in the suspension while preventing flotation and sedimentation of the particles.

The polymerization initiator is readily decomposed by heating, to generate radicals. The generated radicals are added to the unsaturated bonds of the polymarizable monomer, producing new adduct radicals. The resulting adduct radicals are then further added to the unsaturated bonds of the polymerizable monomer. This addition reaction is repeated as a chain reaction, continuing the polymerization reaction to form polymer particles (toner base particles) consisting primarily of the polymerizable monomer, and resulting in a liquid the dispersion of polymer particles (toner base particles).

A distillation step can then be performed as necessary to remove residual polymerizable monomer.

The following are examples of polymerizable monomer used in suspension polymerization; styrenes such as styrene, o-methylstyrene, m-methylstyrene, p-methylstyrene and α-methylstyrene, and derivatives thereof; ethylene unsaturated monoolefins such as ethylene, propylene, butylene and isobutylene; halogenated vinyls such as vinyl chloride, vinylidene chloride, vinyl bromide and vinyl fluoride; vinyl esters such as vinyl acetate, vinyl propionate and vinyl benzoate; acrylic acid esters such as n-butyl acrylate and 2-ethylhexyl acrylate; methacrylic acid esters obtained by substituting, methacryl for acryl in these acrylic esters; methacrylic acid amino esters such as dimethyraminoethyl methacrylate and diethylaminoethyl methacrylate; vinyl ethers such as vinyl methyl ether and vinyl ethyl ether; vinyl ketones such as vinyl methyl ketone; N-vinyl compounds such as N-vinylpyrrole; vinyl naphthalenes; acrylic acid, methacrylic acid, and acrylic or methacrylic acid derivatives such as acrylonitrile, methacrylonitrile, acrylamide, and the like. These polymerizable monomers may be used in combinations of two or more as necessary.

The following are examples of the polymerizable initiator used in suspension polymerization: azo and diazo polymerization initiators, such as 2,2'-azobis-(2, 4-dimethylvaleronitrile), 2, 2'-azobisisobutyronitrile, 1, 1'-azobis (cyclohexane-1-carbonitrile), 2,2'-azobis-4-methoxy-2, 4 -dimethylvalernotrile and azobisisobutyronitrile; and peroxide polymerization initiators such as benzoyl peroxide, methyl ethyl ketone peroxide, diisopropylperoxy carbonate, cumene hydroperoxide, 2,4-dichlorobenzoyl peroxide, lauroyl peroxide and tert-butyl-peroxypivalate.

The amounts of these polymerization initiators that are used vary according to the desired degree of polymerization, but in general from 3.0 to 20.0 mass parts are used per 100.0 mass parts of the polymerizable monomer. The type of polymerization initiator varies somewhat according to the polymerization method, but is selected with reference to the 10-hour half-life temperature, and these may be used singly or in the form of a mixture.

The toner of the invention preferably has an average circularity of 0.960 or more. If the average circularity is 0.960 or more, the cleaning properties are good and fine line reproducibility is improved. More preferably the average circularity of the toner is 0.970 or more.

The effects of the invention are more easily obtained if the content of toner with a circularity of 0.990 or more (spherical content) is 10% or more. The spherical content is the content ratio of circularity 0.900 or more in the toner, and fine line reproducibility is higher the greater the spherical content.

The inorganic fine particle A used in the invention may be wet silica produced by precipitation or a sol-gel process, or dry silica such as deflagration silica or fumed silica, but silica is desirable for obtaining the shape with many depressed portions that is a feature of the invention, and dry silica is especially desirable.

The raw material of the dry silica is a silicon halide compound or the like.

Silicon tetrachloride may be used as the silicon halide compound, but a silane such as methyl trichlorosilane or trichlorosilane may be used as a raw material, either singly or mixed with silicon tetrachloride.

The target silica is obtained by a flame hydrolysis reaction in which the raw material is first gasified and then reacted with water produced as an intermediate in an oxyhyarogon flame.

For example, using a thermal decomposition oxidation reaction of silicon tetrachloride gas in oxygen and hydrogen, the reaction formula is as follows:

$$SiCl_4+2H_2 \rightarrow SiO_2+4HCl$$

A suitable method of manufacturing suitable dry non-spherical silica for use in the present invention is explained below.

Oxygen gas is supplied to a burner and ignited on the ignition burner after which hydrogen gas is supplied to the burner to form a flame, and silicon tetrachloride is supplied as the raw material and gasified.

The average particle diameter and shape can be adjusted at will to prepare an inorganic fine particle shape with many depressed portions by appropriately varying the flow volume of silicon tetrachloride, the flow volume of oxygen gas, the flow volume of hydrogen gas, and the flame retention time of the silica.

One method for obtaining a shape with many depressed portions is to transfer the resulting silica powder to an electrical furnace, spread it into a thin layer, and then sinter it by heat treatment. Sintering increases the unifying strength, of the inorganic fine particles, making it easier to improve the catching, effect in the cleaning part.

The inorganic fine particles A used in the invention may also be subjected to a surface treatment such as hydrophobizing treatment or silicone oil treatment.

Hydrophobizing may be accomplished by chemical treatment with an organic silicon compound that reacts with or is physically adsorbed by the silica. In a preferred method, silica produced by vapor phase oxidation of a silicon halide compound is treated with an organic silicon compound.

The following are examples of such organic silicon compounds:

Hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane;

bromomethyldimethylchlorosilane, α-chloroethyltrichlorosilane, β-chloroethyltrichlorosilane, chloromethyldimethylchlorosilane, triorganosilylmercaptane, trimethylsilylmercaptane, triorganosilylacrylate; and vinyldimethylacetoxysilane, dimethlethoxysilane, dimethyldimethoxysilane, diphenyldiethoxysilane and 1-hexamethyldisiloxane.

Other examples include 1,3-divinyltetramethyldisiloxane, 1,3-diphenyltetramethyldisiloxane, and dimethylpolysiloxanes having 2-12 siloxahe units per molecule and one hydroxyl group on the Si of each unit located at a terminus.

One of these or a mixture of two or more may be used.

In the case of silicone oil-treated silica, it is desirable to use a silicone oil with a viscosity of from 30 $mm^2/s$ to 1000 $mm^2/s$ at 25° C. Examples include dimethyl silicone oil, methylphenyl silicone oil, α-methylstyrene denatured silicone oil, chlorophenyl silicone oil and fluorine denatured silicone oil.

The following are examples of methods of treatment with silicone oil:

A method of mixing silica that has been treated with a silane coupling agent directly with silicone oil in a mixing apparatus such as an FM mixer; and A method of spraying silicone oil on a silica base. In another method, silicone oil is first dissolved or dispersed in a suitable solvent, the silica is added and mixed, and the solvent is removed.

After the silica has been treated with the silicone oil, the treated silica is preferably heated at 200° C. or more (preferably 250° C. or more) in inactive gas to stabilize the suit are coat.

An example of a preferred silane Coupling agent is hexamethyldisilazane (HMDS).

The added amount of these inorganic fine particles A is not particularly limited as long as the desired characteristics are obtained, but is more preferably from 0.2 to 3.0 mass parts per 1000 mass parts of the toner particle.

A second external additive may also be added in the toner of the invention. A silica fine particle or titania fine particle that has undergone hydrophobizing treatment is preferred as the second external additive. The number-average particle diameter is preferably from 5 nm to 40 nm. The method of hydrophobizing treatment may be a method of treatment with an organic silicon compound, silicone oil, or a long-chain fatty acid or the like.

Examples of the organic silicon compound include hexamethyldisilazane, trimethylsilane, trimethylethoxysilane, isobutyltrimethoxysilane, trimethylchlorosilane, dimethylcichlorosilane, methyltrichlorosilane, dimethylethoxysilane, dimethyldimethoxysilane, diphenyldiethoxysilane, hexamethyldisiloxane and the like. One of these or a mixture of two or more may be used.

The silicone oil may be dimethyl silicone oil, methylphenyl silicone oil, α-methylstyrene denatured silicone oil, chlorophenyl silicone oil or fluorine denatured silicone oil.

In the toner of the invention, an inorganic fine particle capable of contributing fluidity to the toner particle surface and having a number-average particle diameter (D1) of from 5 nm to 30 nm of the primary particles in the number-based particle Size distribution is also desirable as a second external additive.

For example, commercial silica is available under the tradenames Aerosil (Nippon Aerosil Co., Ltd.) 130, 200, 300, 380, MOX170, MOX80, COK84, Ca-O-SiL (Cabot Corporation), M-5, MS-7, MS-75, HS-5, EH-5, Wacker HDK N 20 (Wacker-Chemie GmbH) V15, N20E, T30, T40, D-C Fine Silica (Dow Corning Corporation) and Fransol (Fransil Co.), and these can also be used favorably in the present invention.

The content of the second external additive is preferably from 0.1 to 2.0 mass parts or more preferably from 0.5 to 1.0 mass parts per 100.0 mass parts of the toner particles.

The mixer used in the method of adding the external additive to the toner particle may be an FM Mixer (Nippon Coke & Engineering Co., Ltd.), Super Mixer (Kawata Mfg Co., Ltd.), Nobilta (Hosokawa Micron Corporation) or Hybridizer (Nara Machinery Co., Ltd.).

The following are examples of the separating apparatus used to separate out the coarse particles after external addition: Ultrasonic (Koei Sangyo Co., Ltd.); Resona Sieve and Gyro-Sifter (both by Tokuju Co., Ltd.); Vibrasonic System (Dalton Corporation); Soniclean (ShintoKogio, Ltd.); Turbo screener (Freund-turbo Corporation); Micro sifter (Makino Mfg, Co., Ltd.).

The measurement methods used in the present invention are described below.

(Volume-Based Median Diameter (D50) and Span Value of Resin Particle)

Measurement is performed using an LA-920 Horiba laser diffraction/scattering particle size distribution analyzer (Horiba, Ltd.) in accordance with the methods described in the manual of the apparatus.

The dedicated accessory software of the LA-920 (Horibala-920 for Windows WET (LA-920) Ver. 2.02) is used to set the measurement conditions and analyze the measurement data. Ion-exchange water from which solid impurities had been removed in advance is used as the measurement solvent.

The measurement procedures are as follows.

(1) A batch cell holder is attached to the LA-920.

(2) A specific amount of ion-exchange water is added to a batch cell, and the batch cell is set in the batch cell holder.

(3) The inside of the batch cell is agitated with a dedicated stirrer tip.

(4) The "Refractive index" button is pressed on the "Display conditions settings" screen, and filter "120A000I" (relative refractive index 1.20) is selected.

(5) The particle size standard is set to volume standard on the "Display conditions, settings" screen.

(6) Following one hour or more of warm-up operation, light axis adjustment, fine light axis adjustment and blank measurement are performed.

(7) A dispersion solution is prepared of the resin particle adjusted with ion-exchange water to a solids concentration of 0.05 mass %. 20 ml of this dispersion solution is placed in a 100 ml glass flat-bottomed beaker.

(8) Two oscillators: with an oscillation frequency of 50 kHz are built-in with their phases shifted by 180° to one another, and an Ultrasonic Dispersion System Tetora. 150 ultrasonic disperser (Nikkaki Bios Co., Ltd.) with an electrical output of 120 W is prepared. 3.3 L of ion-exchange water is placed in the water bath of the ultrasonic disperser, and 2 ml of Contaminon N is added to this water bath.

(9) The beaker from (7) above is set in the beaker fixing hole of the ultrasonic disperser, and the ultrasonic disperser is operated. The height position of the beaker is adjusted so as to maximize the resonance state of the surface of the aqueous solution in the beaker.

(10) The aqueous solution in the beaker from (9) above is subjected to 60 seconds of ultrasonic dispersion treatment. During ultrasonic dispersion, the water temperature of the bath is adjusted appropriately to a temperature from 10° C. to 40° C.

(11) The aqueous solution of dispersed resin particles prepared in (10) above is immediately added little by little to the batch cell, taking care to exclude air bubbles, and the transmissivity of a tungsten lamp is adjusted 90% to 95%. The particle size distribution is then measured. The median diameter (D50) is determined based on the resulting volume-based particle size distribution data and the 10% cumulative diameter and 90% cumulative diameter are calculated and used to find the span value A.

$$\text{Span value } A=(D90-D10)/D50$$

(Glass Transition Temperature (Tg))

The glass transition temperatures (Tg) of the toner Base particle and resin particle are measured as follows using an M-DSC differential scanning calorimeter (DSC) (Product name Q2000, TA Instruments). A 3 mg measurement sample is weighed, and placed in an aluminum pan, and measurement, is performed within a measurement temperature range of 20° C. to 200° C. at a ramp rate of 1° C./minute at normal temperature, normal, humidity using an empty aluminum pan as a reference. Measurement is performed at a frequency of 1/min at the modulation amplitude ±0.5° C. The glass transition temperature (Tg: ° C.) is calculated from the resulting reversing heat flow curve. The Tg (° C.) is determined as the center value of the intersection of the base lines before and after endothermic absorption and the tangential line of the curve due to heat absorption.

(Acid Value)

The acid value represents the number of mg of potassium hydroxide required to neutralize the acid contained in 1 g of sample. In the present invention the acid value is measured in accordance with JIS K 0070-1992, and specifically is measured by the following procedures.

Titration is performed using a 0.1 mole/L potassium hydroxide ethyl alcohol solution (Kishida Chemical Co., Ltd.). The factor of this potassium hydroxide ethyl alcohol solution can be determined with a potentiometric titrator (Kyoto Electronics Manufacturing co., Ltd. AT-510 potentiometric titrator). 100 ml of 0.100 mole/L hydrochloric acid is placed in 250 ml fall beaker, and titrated with the potassium hydroxide ethyl alcohol solution, and the amount of potassium hydroxide ethyl alcohol solution required for neutralization is determined. The 0.100 mole/L hydrochloric acid is prepared in accordance with JIS K 8001-1998.

The measurement conditions for acid value measurement are shown below.

Titration unit: AT-510 potentiometric titrator (Kyoto Electronics Manufacturing Co., Ltd.)

Electrodes: Composite glass electrode double junction (Kyoto Electronics Manufacturing., Ltd.)

Titration unit control software; AT-WIN

Titration analysis software: Tview

The titration parameters and control parameters during titration are set as follows.

Titration Parameters

Titration mode: Blank titration

Titration format: Total titration

Maximum titrated amounts 20 ml

Waiting time before titration: 30 seconds

Titration direction: Automatic

Control Parameters

End point determination potential: 30 dE

End point determination potential value: 50 dE/dmL

End point detection judgment; Not set

Control speed mode: Standard

Gain 1

Data acquisition potential; 4 mV

Data acquisition titrated amount: 0.1 ml

Main Test 0.100 g of measurement sample is weighed in a 250 ml tall beaker, 150 ml of a mixed toluene/ethanol (3:1) solution is added, and the sample is dissolved over the course of one hour. Titration is performed with the potassium hydroxide ethyl alcohol solution using the potentiometric titrator described above.

Blank Test

Titration is performed by operations similar to those described above except that no sample is used (that is, using only a mixed toluene/ethanol (3:1) solution).

The results are substituted into the following formula to calculate the acid value.

$$A=[(C-B)\times f\times 5.611]/S$$

(In the formula, A is the acid value (mgKOH/g), B is the added amount (ml) of the potassium hydroxide ethyl alcohol solution in the blank test, C is the added amount (ml) of the potassium hydroxide ethyl alcohol solution in the main test, f is the factor of the potassium hydroxide solution, and S is the sample (g).

(Acid Value, pKa)

0.100 g of the measurement sample is weighed into a 250 ml tall beaker, 150 ml of THF is added, and the sample is dissolved over the course of 30 minutes. A pH electrode is placed in this solution, and the pH of the THF solution of the sample is read. Next, a 0.1 mole/L potassium hydroxide ethyl alcohol solution (Kishida Chemical Co., Ltd.) is added in batches of 10 μl, and the pH is read as titration is performed. 1 mole/L potassium hydroxide ethyl alcohol solution is added until the pH is 10 or more and there is no change in pH even when 30 μl is added. A plot of pH against added amount of 0.1 mole/L potassium hydroxide ethyl alcohol solution is obtained from the results, to produce a titration curve. Based on this titration curve, the point at which the slope of the pH change is greatest is given as the neutralization point, and the acid value (mgKOH/g) is calculated from the added amount of potassium hydroxide. Because the pKa is the same value as the pH at half the amount of 0.1 mole/L potassium hydroxide ethyl alcohol solution required up to the neutralization point, the pH at the half amount is read from the titration curve.

(Method of Measuring Number-Average Particle Diameter of Fine Particle)

The number-average particle diameter (D1) of the external additive is measured using a scanning electron microscope (S-4800 (product name), Hitachi, Ltd.). The toner with the external additive is observed, and in a visual field enlarged to a maximum 200,000× magnification, the long axes of 100 randomly selected primary particles of the external additive are measured and used to determine the number-average particle diameter (D1). The magnification is adjusted appropriately according to the size of the external additive.

(Method of Measuring Average Circularity of Toner)

The average circularity of the toner is measured with an FPIA-3000 flow particle imaging instrument (Sysmex Corporation), under the measurement and analysis conditions for correction operations.

The specific measurement methods are as follows. First, about 20 ml of ion-exchange water from which solid impurities have been removed in advance is placed in a glass container. About 0.2 mL of a diluted solution of the dispersant "Contaminon N" (a 10% by mass aqueous solution of a neutral detergent for washing precision measuring devices formed from a nonionic surfactant, an anionic surfactant, and an organic builder and having a pH of 7, manufactured by Wako Pure Chemical Industries, Ltd.) diluted 3 times with ion-exchange water is added. About 0.02 g of the measurement sample is then added, and dispersed for 2 minutes with an ultrasonic disperser, to obtain a dispersion solution for measurement. At this point the dispersion solution is cooled appropriately so that its temperature is from 10° C. to 40° C. Using a tabletop ultrasonic cleaning disperser with an oscillating frequency of 50 kHz and an electrical output of 150 W (such as the Velvo-Clear VS-150) as the ultrasonic disperser, a specific amount of ion-exchange water is placed in the water bath, and about 2 mL of Contaminon N is added to this bath.

Measurement was performed using the previous flow particle imaging instrument equipped with a UPlanApro objective lens (magnification 10×x, numerical aperture, 0.40), with Particle Sheath PSE-900A (Sysmex Corporation) as the sheath liquid. A dispersion solution prepared in accordance with the above procedures is introduced into the flow particle imaging instrument, and 3000 toner particles are measured in HPF measurement mode and in total count mode. With the binarization threshold during particle analysis set to 85%, and the range of analyzed particle diameters restricted to equivalent circular diameter from 1.985 μm to 39.69 far, the average circularity of the toner is determined.

Automatic focus adjustment is performed using standard latex particles (such as Duke Scientific Corporation "Research and Test Particles Latex Microsphere Suspensions 5200A", diluted with ion-exchange water) prior to the start of measurement. Focus adjustment is then preferably performed every 2 hours after the start of measurement.

The flow particle imaging instrument used in the examples of this application had been corrected by Sysmex Corporation and had a correct ion certificate issued by Sysmex Corporation. Measurement was performed under the measurement and analysis conditions covered by the correction certificate, except that the range of analyzed particle diameters was restricted to equivalent circular diameter from 1.985 μm to 39.69 μm.

(Method of Measuring Weight-Average Particle Diameter, (D4) and Number-Average Particle Diameter (D1))

The weight-average particle diameter (D1) and number-average particle diameter (D1) of the toner are measured with a precise particle size distribution measurement device based on the pore electrical resistance method and equipped with a 100 μm aperture tube (Coulter Counter Multisizer 3, registered trademark, Beckman Coulter, Inc.), using the attached dedicated software (Beckman Coulter Multisizer 3 Version 3.51, Beckman Coulter, Inc.) for the settings and measurement data analysis, with 25,000 effective measurement channels, and the measurement data were analyzed to calculate the diameters.

The aqueous electrolytic solution used in measurement may be special-grade sodium chloride dissolved in ion-exchange water to a concentration of about 1 mass %, such as "Isoton II" (Beckman Coulter, Inc.) for example.

The dedicated software settings were performed as follows prior to measurement and analysis.

On the "Standard measurement method changes (SOMME)" screen of the dedicated software, the total count in control mode is set to 50,000 particles, the number of measurements to one, and the Kd value to a value obtained using "standard 10.0 μm particles" (Beckman Coulter, Inc.). The threshold noise level is set automatically by pushing the "Threshold/Noise Level" measurement button. The current is set to 1600 μA, the gain to 2, and the electrolytic solution to ISOTON II, and a check is entered for aperture tube flush after measurement.

On the "Conversion settings from pulse to particle diameter" screen of the dedicated Software, the bin interval is set to the logarithmic particle diameter, the particle diameter bins to 256, and the particle diameter range to 2 μm to 60 μm.

The specific measurement methods are as follows.

(1) About 200 ml of the aqueous electrolytic solution is placed in a 250 ml glass round-bottomed beaker dedicated to the Multisizer 3, set on a sample stand, and stirred with a stirrer rod counterclockwise at a rate of 24 rotations/second. Contamination and bubbles in the aperture tube are removed by means of the "Aperture flush" function of the analytical software.

(2) Approximately 30 ml of the aqueous electrolytic solution is placed in a 100 ml glass flat-bottom beaker and approximately 0.3 ml of a diluted solution of "Contaminon N" (a 10% by mass aqueous solution of a pH 7neutral detergent for washing precision measurement equipment, comprising a nonionic surfactant, an anionic surfactant and an organic builder, made by Wako Pure Chemical industries, Ltd.) diluted 3 times by mass with ion-exchange water is added thereto as a dispersant.

(3) A predetermined amount (3.3 liter) of ion-exchange water is placed in a water bath of an "Ultrasonic Dispersion System Tetora ISO" ultrasonic disperser (Nikkaki-Bios Co., Ltd.) with an electric output of 120 W, in which two oscillators with an oscillation frequency of 50 kHz are built-in with the phases of the oscillators shifted by 180° to one other. About 2 ml of the Contaminon N is added to the water bath.

(4) The beaker of (2) above is set in the beaker fixing hole of the ultrasonic disperser, and the ultrasonic disperser is operated. The height position of the beaker is adjusted so as to maximize the resonance state of the surface of the aqueous electrolytic solution in the beaker.

(5) With the aqueous electrolytic solution in the beaker of (4) above exposed to ultrasound waves, approximately 10 mg of the toner is added little by little to the aqueous electrolytic solution, and dispersed. Further, ultrasonic dispersion is continued for another 60 seconds. During ultrasonic dispersion, the temperature of the water in the water bath is properly adjusted so as to be not less than 10° C. and not more than 40° C.

(6) Using a pipette, the aqueous electrolytic solution of (5) with the toner dispersed therein is added dropwise to the round-bottom beaker of (1) above disposed on the sample stand, and the measurement concentration is adjusted so as to be approximately 5%. Measurement is then performed until the number of measured particles reaches 50,000.

(7) The measurement data is analyzed with the dedicated software attached to the apparatus, and the weight-average particle diameter (124) and number-average particle diameter (D1) are calculated. The weight-average particle diameter (D4) is the "average diameter" on the analysis/volume statistical value (arithmetic average) screen when graph/vol % is set by the dedicated software, and the number-average diameter (D1) is the "average diameter" on the analysis/number statistical value (arithmetic average) screen when graph/number % is set.

(Methods for Measuring Average Compactness Value and Average Minimum Feret Diameter of Inorganic Fine Particles A)

These can be determined by observing the inorganic fine particles A under a scanning electron microscope and analyzing the images. A Hitachi S-4800 high-resolution field emission scanning electron microscope (Hitachi High-Technologies Corporation) may be used as the scanning electron microscope.

For the observation conditions, the magnification is adjusted appropriately in the range of 100,000 to 200,000depending on the size of the inorganic fine particle. For image processing of the inorganic fine particles, the back-scattered electron image is preferably observed with the. acceleration voltage during observation adjusted to a high value (such as 10 kV) so that the inorganic fine particles appear with high brightness.

Image processing is performed with Image J image analysis software (developed by Wayne Rasband), the background and the inorganic fine particles appearing with high brightness are binarized, and the area of each inorganic fine particle and. the area of region enclosed by envelope of inorganic fine particle are calculated and used to calculate average compactness according to Formula (2) below. The binarization conditions may be selected appropriately depending the observation equipment and the sputtering conditions. The compactness of each inorganic fine particle can be obtained as "Solidity" in the Image J image analysis software.

Compactness=area of inorganic fine particle/area of region enclosed by envelope of inorganic fine particle Formula (2)

The specific measurement methods are as follows.

Image Analysis

Average compactness is calculated from the resulting SEM images using the Image J image analysis software (developed by Wayne Rashand). The calculation steps are as follows.

1) Scale is set under [Analyze]—[Set Scale]

2) Threshold is set under [Image]—[Adjust]—[Threshold] (set to a value at which the inorganic fine particles remain as the object of measurement, with no residual noise)

3) The image part of the measured inorganic fine particle is selected under [Image]—[Crop]

4) Overlapping particles are eliminated by image editing

5) The white and black images are inverted under [Edit]—[Invert]

6) [Area], [Shape Descriptors], [Perimeter], [Fit Ellipse] and [Feret Diameter] are checked under [Analyze]—[Set Measurements], [Redirect to] is set to [None], and [Decimal Place (0-9)] is set to 3.

7) Analysis is performed with the particle area specified as 0.005 $\mu m^2$ or more under [Analyze]—[Analyze Particle]

8) Values are obtained for Solidity and minimum Feret diameter of each particle indicated in 7) above.

9) Measurement is performed on 100 observed images, and the additive average of the resulting Solidity values is calculated and given as the average value of compactness. Similarly, the additive average of the resulting minimum Feret diameters is calculated and given as the average minimum Feret diameter.

(Method For Measuring Average Long-Side Length (D) and Average Height (H) of Protruded Portions of Toner Particle Surfaces)

In a toner in which multiple external additives have been added externally to the toner particles, it is necessary to remove the external additives from the toner particles when measuring the average long-side length (D) and average height (H) of the protruded portions of the toner particle surfaces. The following method can be used for example to remove the external additives from the toner particles.

(1) 5 g of toner is placed in a sample jar, and 200 ml of methanol is added.

(2) The sample is dispersed for 5 minutes with an ultrasound cleaning apparatus to separate the external additives.

(3) The external additives are separated from the toner particles by suction filtration (10 μm membrane filter).

(4) Steps (2) and (3) are performed a total of 3 times.

Toner particles from which the external additives have been removed can be obtained by these operations.

Toner particle cross-sections are prepared from the resulting toner particles with a Joel Ltd. Cross Section Polisher (SM-09010(product name)). As the specific method, a piece of carbon double-faced adhesive tape (Nisshin EM Co., Ltd. carbon double-faced tape for SEM) was affixed to a silicon wafer, Mo mesh (diameter 3 mm, thickness 30 μm) was fixed thereon, and about 1 layer (thickness about 1 toner particle) of the toner was attached thereto. Platinum was deposited thereon, and a toner particle cross-section was formed with the cross section polisher under conditions of acceleration voltage 4 kv, processing time 3 hours.

The protruded portions on the surface of the toner particles were observed from the resulting toner particle cross-section with a S-4800 scanning electron microscope (Hitachi, Ltd.).

Differences in brightness (contrast) under SEM observation were used to determine whether the protruded portions originated in the resin particles.

The visual field and magnification are adjusted appropriately so that the shapes of the protruded portions are easily distinguished during observation. The raised areas at either end of each protruding portion are connected with a straight line, the length from the straight line to the apex of the protruding portion is given as the height, and the part parallel to this straight line at which the length of the protruding portion is maximum is given as the long side. The heights and long sides of 100 randomly selected protruded portions were observed, and the additive averages of each were given as the average height (H) and average long-side length (D; of the protruded portions.

(Method for Measuring Abundance of Resin Particles on Toner Particle Surface)

The external additives were removed by operations similar to those used when measuring the average long-side length (D) and average height (H) of the protruded portions of the toiler particle surfaces, and the surfaces of the toner particles were observed under an S-4800 scanning electron microscope.

Figure 3:
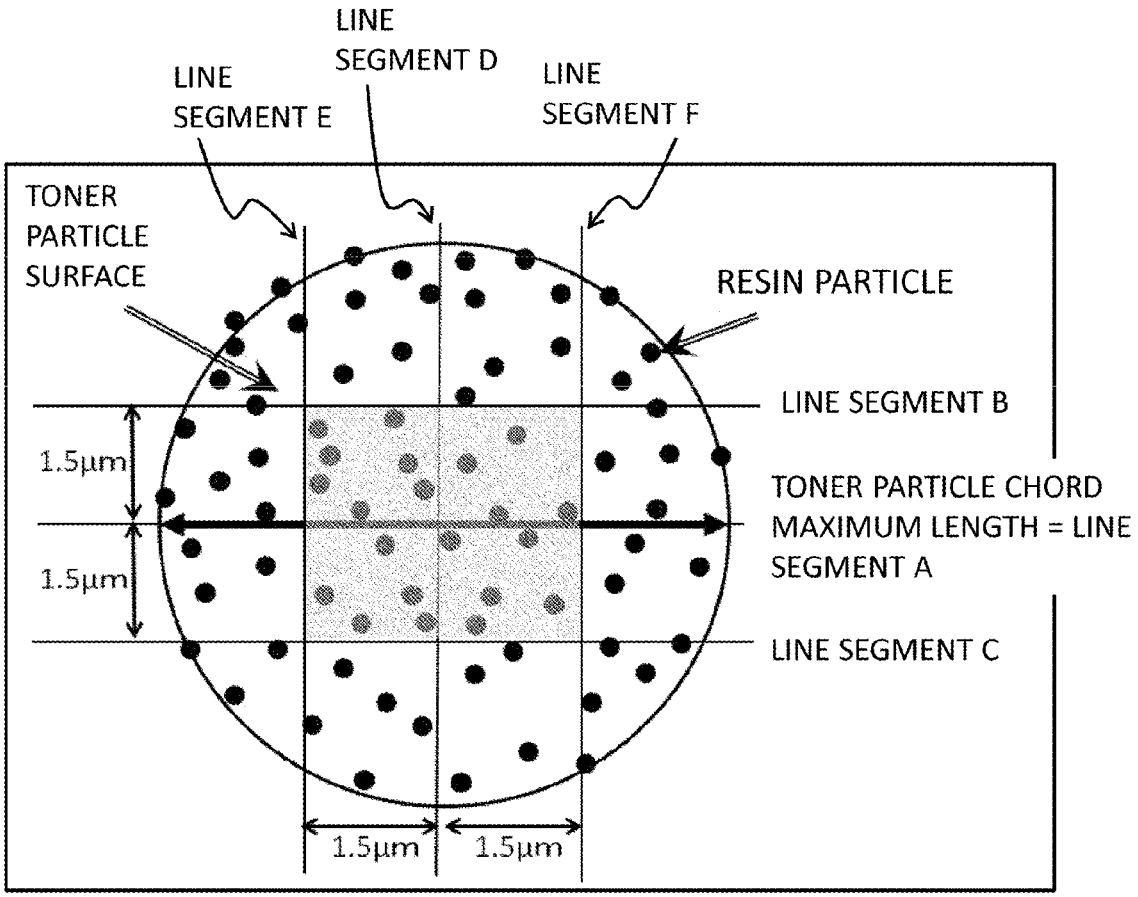
FIG. 3 is an example showing four regions in a backscattered electron image of a toner particle.

A backscattered electron image of one toner particle is observed at a magnification of 20,000 times with the S-4800 scanning electron, microscope (Hitachi, Ltd.). As shown in FIG. 3, the maximum length of the chord of the toner particle is given as line segment A, and two straight lines parallel to and 1.5 μm distant from line segment A are given as line B and line C in the backscattered electron image of the toner particle. A straight line passing through the center point of line segment A at a right angle is given as line D, and two straight lines parallel to and 1.5 μm distant from line D are given as line E and line F. Four square regions each, 1.5 μm on a side are defined by the line segment A and the straight lines B, C, D, E and F.

The area occupied by resin particles in each of the four regions was calculated using Image-Pro Plus 5.1J image processing software (Media Cybernetics, Inc.). The ratio of this calculated area to the area of each of four regions (calculated area/2.25 μm) was given as the particle abundance in that region.

This operation was performed on 50 toner particles, and the average value was given as the average abundance of the resin particles.

To measure the coefficient of variation of the toner particles, a backscattered electron image of a toner particle was observed at a magnification of 20,000 with the S-4800 scanning electron microscope (Hitachi, Ltd.). In this backscattered electron image of the toner particle, four square regions each 1.5 μm on a side are defined by the line segment A and the straight lines B, C, D, E and F.

The number of resin particles in each region is calculated, and the numbers of particles in all regions are added together to calculate the number of resin particles on the surface of one toner particle. This operation is performed on S50 toner particles, and the standard deviation of the number of resin particles on the toner particle surface is calculated and used to calculate the coefficient of variation according to Formula (3).

Coefficient of variation=(standard deviation of number of particles/average number of particles present) Formula (3)

EXAMPLES

The present invention is explained in detail below using examples, but the invention is not limited to these examples. "Parts" below mean parts by mass.

(Synthesis Example of Polymerizable Monomer M-1)

(Step 1)

100 g of 2,5-dihydroxybenzoic acid and 1441 g of 80% sulfuric acid were heated and mixed at 50° C. 144 g of tert-butyl alcohol was added to this dispersion, and agitated for 30 minutes at 50° C. The operation of adding 144 g tert-butyl alcohol to the dispersion and agitating for 30 minutes was then performed three times. The reaction solution was cooled to room temperature, and slowly poured into 1 kg of ice water. The precipitate was filtered and water washed, and then washed with hexane. This precipitate was dissolved in 200 mL of methanol, and re-suspended in 3.6 L of water. After filtration, this was dried at 80° C. to obtain 74.9 of the salicylic acid intermediate shown by structural formula (5) below.

(5)

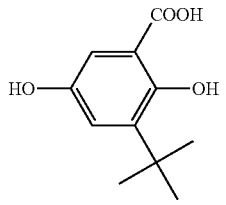

(Step 2)

25.0 g of the resulting salicylic acid intermediate was dissolved in 150 mL of methanol, and heated to 65° C. following addition of 36.9 g of potassium carbonate. A mixture of 18.7 g of 4-(chloromethyl) styrene and 100 mL of methanol was added dropwise to this reaction solution, and reacted for 3 hours at 65° C. The reaction solution was cooled and filtered, and the filtrate was concentrated to obtain a raw product. The raw product was dispersed in 1.5 L of water with a pH of 2, and extracted by adding ethyl acetate. This was then water washed and dried with magnesium sulfate, and the ethyl acetate was evaporated under reduced pressure to obtain a precipitate. The precipitate was washed with hexane and purified by re-crystallization in toluene and ethyl acetate to obtain 20.1 g of the polymerizable monomer m-1 shown by structural formula (6) below.

(6)

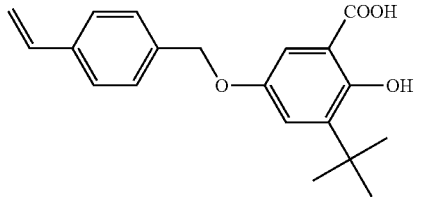

(Synthesis Example of Polymer 1)

The polymerizable monomer M-1 shown by structural formula (6) (9.2 g) and styrene (60.8 g) were dissolved in 42.0 ml of DMF, agitated for 1 hour with nitrogen bubbling, and then heated to 110° C. A mixed solution of 2.1 g of tert-butyl peroxyisopropyl monocarbonate (Perbutyl I (product name), NOF Corporation,) as an initiator and 45 ml of toluene was added dropwise to this reaction solution. This was then, reacted for 5 hours at 100° C. This was then cooled and added dropwise to 1 L of methanol to obtain a precipitate. The resulting precipitate was dissolved in 120 ml of THF, and added dropwise to 1.80 L of methanol to produce a white precipitate which was filtered and dried at 100° C. under reduced pressure to obtain a Polymer 1.

(Synthesis Example of Polymer 2)

200 mass parte of xylene were loaded into a reaction container equipped with an agitator, a condenser, a thermometer and a nitrogen introduction tube, and refluxed in a flow of nitrogen. The following monomers were mixed, added dropwise to the reaction container with agitation, and retained for 10 hours:

| | |
|---|---|
| 2-acrylamido-2-methylpropanesulfonic acid | 6.0 mass parts |
| Styrene | 72.0 mass parts |
| 2-ethylhexylacrylate | 18.0 mass parts |

The solvent was then removed by distillation, and the remainder was dried at 40° C. under reduced pressure to obtain a Polymer 2.

(Synthesis Example of Polymer 3)

200 mass parts of xylene were loaded into a reaction container equipped with an agitator, a condenser, a thermometer and a nitrogen introduction tube, and refluxed in a flow of nitrogen. The following monomers were mixed, added dropwise to the reaction container with agitation, and retained for 11 hours:

| | |
|---|---|
| 5-vinylsalicylic acid | 9.0 mass parts |
| Styrene | 75.0 mass parts |
| 2-ethylhexylacrylate | 16.0 mass parts |
| Dimethyl-2,2'-azobis(2-methylpropionate) | 5.0 mass parts |

The solvent was then removed by distillation, and the remainder was dried at 45° C. under reduced pressure to obtain a Polymer 3.

(Synthesis Example of Polymer 4)

Synthesis was performed as in the synthesis example of Polymer 3, but with 5.3 mass parts of phthalic acid-1-vinyl substituted for the 9.0 mass parts of 5-vinylsalicylic acid, to obtain a Polymer 4.

(Synthesis Example of Polymer 5)

Synthesis was performed as in the synthesis example of Polymer 3, but with 10.9 mass parts of 1-vinylnaphthalene-2-carboxylic acid substituted for the 9.0 mass parts of S-vinylsalicylic acid, to obtain a Polymer 5.

(Synthesis Example of Polymer 6)

The following were loaded into a reaction container equipped with a nitrogen introduction tube, a dewatering tube, an agitator and a thermocouple:

| | |
|---|---|
| Bisphenol A propylene oxide 2-mole adduct | 500 mass parts |
| Terephthalic acid | 154 mass parts |
| Fumaric acid | 45 mass parts |
| Tin octylate | 2 mass parts |

A polycondensation reaction was performed for 8 hours at 230° C., the polycondensation reaction was then continued for 1 hour at 8 kPa, and the mixture was cooled to 160° C. to form a polyester resin, after which 10 mass parts of acrylic acid were added at 60° C., mixed and retained, for 15 minutes. A mixture of the following was then added dropwise over the course of 1 hour with a dropping funnel:

| | |
|---|---|
| Styrene | 142 mass parts |
| n-butyl acrylate | 35 mass parts |
| Polymerization initiator (di-t-butyl peroxide) | 10 mass parts |

An addition polymerization reaction was performed over the course of 1 hour with the temperature maintained at 160° C., after which the mixture was warmed to 200° C. and retained for 1 hour at 10 kPa to obtain a Polymer 6.

The physical properties of the Polymers 1 to 6 are shown in Table 1.

TABLE 1

| | Polymerizable monomer M | | | | | | |
|---|---|---|---|---|---|---|---|
| | Type | Charged amount (g) | St | 2EHA | Initiator | Tg (° C.) | Acid dissociation constant pKa |
| Polymer 1 | Polymerizable monomer M-1 | 9.2 | 60.8 | 0.0 | 2.1 | 105.0 | 7.3 |
| Polymer 2 | | Described in Description | | | | 68.9 | −0.6 |
| Polymer 3 | | Described in Description | | | | 78.3 | 6.5 |
| Polymer 4 | | Described in Description | | | | 86.4 | 8.0 |
| Polymer 5 | | Described in Description | | | | 81.2 | 8.9 |
| Polymer 6 | | Described in Description | | | | 58.1 | 5.5 |

(Manufacturing Example: Aqueous Dispersion of Resin Particle 1)

200.0 mass parts of methyl ethyl ketone were loaded into a reaction container equipped with an agitator, a condenser, a thermometer and a nitrogen introduction tube, and 100.0 parts of the Polymer 1 were added and dissolved.

Next, 28.6 parts of a 1.0 mole/liter aqueous potassium hydroxide solution were slowly added, and agitated for 10 minutes, after which 500.0 mass parts of ion-exchange water were slowly added dropwise to obtain an emulsion. The solvent was removed from, the emulsion by vacuum distillation, and ion-exchange water was added to adjust the resin concentration to 20% to obtain an aqueous dispersion of the resin particle 1.

The physical properties of the resulting aqueous dispersion of the resin particle are shown in Table 2.

(Manufacturing Examples: Aqueous Dispersions of Resin Particles 2 to 11)

Aqueous dispersions of the resin particles 2 to 11 were obtained as in the manufacturing example of resin particle 1 except that the polymer 1, the amount of the 1.0 mole/liter potassium hydroxide solution and the solvent were changed as shown in Table 2.

The physical properties of the resulting aqueous dispersions of resin particles 2 to 11 are shown in Table 2.

TABLE 2

| Aqueous dispersion | Polymer type | KOH (mass parts) | Solvent type | Amount of solvent (mass parts) | Particle diameter D50 (nm) | Span value |
|---|---|---|---|---|---|---|
| Resin particle 1 | Polymer 1 | 28.6 | MEK | 200 | 130 | 1.6 |
| Resin particle 2 | Polymer 1 | 33.4 | MEK | 200 | 70 | 1.4 |
| Resin particle 3 | Polymer 1 | 23.9 | MEK | 200 | 200 | 1.7 |
| Resin particle 4 | Polymer 2 | 32.1 | MEK | 300 | 130 | 1.0 |
| Resin particle 5 | Polymer 2 | 31.9 | THF | 150 | 250 | 1.2 |
| Resin particle 6 | Polymer 3 | 50.0 | MEK | 200 | 132 | 1.5 |
| Resin particle 7 | Polymer 4 | 44.1 | MEK | 200 | 128 | 1.6 |
| Resin particle 8 | Polymer 5 | 43.7 | MEK | 200 | 135 | 1.4 |
| Resin particle 9 | Polymer 2 | 30.6 | THF | 300 | 320 | 1.3 |
| Resin particle 10 | Polymer 2 | 37.4 | MEK | 200 | 40 | 0.9 |
| Resin particle 11 | Polymer 6 | 18.4 | MEK | 200 | 130 | 1.0 |

*MEK: methyl ethyl ketone
THF: tetrahydrofuran (Manufacturing Example: Inorganic Fine Particle A-1)

Oxygen gas was supplied to a burner, the ignition burner was ignited, hydrogen gas was supplied to the burner to form a flame, and silicon tetrachloride was then added as a raw material and gasified to obtain silica fine particles. Specifically, this was prepared by the methods described in Japanese Patent Application Laid-open No. 2002-3213. That is, the amount of the raw material silicon tetrachloride gas was 150 kg/hr, the amount of hydrogen gas was 50 $Nm^3$hr and the amount of oxygen gas. was 30 $Nm^3$/hr, the silica concentration in the flame was 0.50 kg/$Nm^3$, and the retention time was. 0.020 sec.

10 mass parts of hexamethyldisilane as a surface treatment agent were added to 100 mass parts of the resulting silica fine particles to perform hydrophobic treatment. The physical properties of the inorganic fine particles are shown in Table 3.

(Manufacturing Example: Inorganic Fine Particles A-2)

Silica fine particles were collected in the manufacturing example of the inorganic fine particles and the resulting silica fine particles were transferred to an electric furnace and spread into a thin layer, and then sintered and aggregated by heat 900° C. These were then surface treated in the same way as the inorganic fine particles A-1 to obtain inorganic fine particles A-2. The physical properties of the inorganic fine particles are shown in Table 3.

(Manufacturing Examples: Inorganic Fine Particles A-3 to A-5)

The amount of silicon tetrachloride, amount of oxygen gas, amount of hydrogen gas, silica concentration and retention time were adjusted with reference to Japanese Patent Application Laid-open No. 2002-3213 to obtain inorganic fine particles A-3 to A-5.

The physical properties of the inorganic fine particles A-3 to A-5 are shown in Table 3.

(Manufacturing Example: Inorganic Fine Particles A-6)

Silicon oxide fine powder SO-E1 (particle shape; spherical, Admatechs ) was transferred to an electrical furnace, spread into a thin layer, and sintered and aggregated toy heat treatment at 900° C. to obtain inorganic fine particles A-6. The physical properties of the inorganic fine particles A-6 are shown in Table 3.

(Manufacturing Example: Inorganic Fine Particles A-7)

The amount of silicon tetrachloride, amount of oxygen gas, amount of hydrogen gas, silica concentration and retention time were adjusted with reference to Japanese Patent Application Laid-open No. 2002-3213 to obtain inorganic fine particles A-7. The physical properties of the inorganic fine particles A-7 are shown in Table 3.

(Manufacturing Example: Inorganic Fine Particles A-8)

Silicon oxide fine powder SO-E1 (particle shape: spherical, Admatechs) was used. The physical properties of the inorganic fine particles A-8 are shown in Table 3.

(Manufacturing example: Inorganic Fine Particles A-9)

Titanium oxide TTO-D2 (particle shape: needle, Ishihara Sangyo) was used. The physical properties of the inorganic fine particles A-9 are shown in Table 3.

TABLE 3

| | | A-1 | A-2 | A-3 | A-4 | A-5 | A-6 | A-7 | A-8 | A-9 |
|---|---|---|---|---|---|---|---|---|---|---|
| Physical properties of inorganic fine particles | BET specific surface area ($m^2/g$) | 28 | 27 | 33 | 34 | 57 | 16 | 84 | 17 | 45 |
| | Average Minimum Feret diameter (nm) | 215 | 210 | 144 | 130 | 62 | 320 | 42 | 310 | 120 |
| | Compactness | 0.70 | 0.63 | 0.67 | 0.75 | 0.75 | 0.78 | 0.72 | 0.83 | 0.38 |

(Manufacturing Example: Toner Particle 1)

(Liquid Dispersion Preparation Step)

850.0 mass parts of an aqueous 0.1 mol/L $Na_3PO_4$ solution were added to a container equipped with a high-speed Clearmix agitator (M Technique Co., Ltd.), and heated to 60° C. with the rotating speed adjusted to 15,000$s^{-1}$. 68.0 mass parts of a 1.0 mol/L aqueous $CaCl_2$ solution were then added to prepare an aqueous medium containing calcium phosphate, which was then agitated for 30 minutes, after which a 1.0 mol/L HCl aqueous solution was added to give the aqueous medium a pH of 6.0.

The following materials were dissolved while being agitated at 100 $s^{-1}$ with a propeller agitator to prepare a solution.

| | |
|---|---|
| Styrene | 72.0 mass parts |
| n-butyl acrylate | 28.0 mass parts |
| Saturated polyester resin | 4.0 mass parts |

(Terephthalic Acid-Propylene Oxide Denatured Bisphehol A Copolymer, Acid Value 13 mgKOH/g, Mw 14,500)

The following materials were then added to the solution.

| | |
|---|---|
| C.I. pigment blue 15:3 | 6.5 mass parts |
| Ester wax | 10.0 mass parts |

(Primary component $C_{21}H_{43}COOC_{22}H_{45}$, melting point 72.5° C.)

After, this, the mixture was heated to 60° C. and then, by an FM mixer (Nippon Coke & Engineering Co., Ltd.), the mixture was agitated, dissolved, and dispersed. 10.0 mass parts of the polymerization initiator 2,2'-azobis (2,4-dimethylvalerontrile) were then dissolved to prepare a polymerizable monomer composition. The polymerizable monomer composition was then added to the previous aqueous medium, and granulated for 15 minutes at 60° C. with the Clearmix rotating at 15,000 $s^{-1}$.

This was then transferred to a propeller agitator equipped with reflux tube, a thermometer and a nitrogen introduction tube, and reacted for 5 hours at 70° C. with agitation at 100 $s^{-1}$, after which the temperature was raised to 80° C., and the reaction was continued for a further 5 hours.

Next, 200.0 mass parts of ion-exchange water were added, the reflux tube was removed, and a distillation apparatus was attached. Distillation was performed for 5 hours with temperature inside the container at 100° C. The distillation fraction was 700.0 mass parts. This was cooled to 30° C. to obtain a polymer slurry. Ion-exchange water was added to adjust the polymer particle concentration of the dispersion to 20% and obtain a liquid dispersion of toner base particles.

A small amount of the resulting liquid dispersion of toner base particles was extracted, 10% hydrochloric acid was added, to adjust the pH to 1.0, and the dispersion was agitated for 2 hours, filtered, thoroughly washed with ion-exchange water and dried, and the glass transition temperature Tg was measured. The Tg was 52.5° C.

(pH Adjustment Step)

500.0 of the above liquid dispersion of toner base particles (solids 100.0 mass parts) was placed in a reaction container equipped with a reflux condenser, an agitator and a thermometer, and the temperature was raised to 80° C. (pH adjustment temperature) using a heating oil bath. The liquid dispersion was agitated as a 1.0 mole/liter potassium hydroxide aqueous solution (pH adjuster) was added to adjust the pH to 9.0. Following pH adjustment a small amount of the liquid dispersion of toner base particles was extracted, and the zeta potential was measured. The zeta potential was −18.5 mV.

(Resin Particle Addition Step)

The pH-adjusted liquid dispersion of toner base particles was then agitated at 200 $s^{-1}$ with the temperature maintained at 80° C. (addition temperature) as 2.5 mass parts (solids 0.5 mass parts) of an aqueous dispersion of resin particles 1 was gradually added. An aqueous dispersion of resin particles 1 was also prepared separately, the pH of the aqueous dispersion of resin particles was adjusted to the pH (pH 9.0) of the liquid dispersion of toner base particles obtained in the pH adjustment step, and the zeta potential was measured. The zeta potential was −79.5 mV.

(Attachment of Resin Particles)

Next, the liquid dispersion of toner base particles with the added resin particles was agitated continuously for 1 hour at 80° C. (attachment temperature). The liquid dispersion was then cooled to 20° C., 10% hydrochloric acid was added to obtain a pH of 1.0, and the mixture was agitated for 2 hours and filtered. This was then thoroughly washed with ion-exchange water, and dried and sorted to obtain Toner Particle 1.

(Manufacturing Examples: Toner Particles 2 to 21)

Toner particles 2 to 21 were manufactured in the same way as Toner particle 1 with the conditions for each step altered, as shown in Table 4. In the case of Toner particle 16, the steps after the pH adjustment step were omitted.

TABLE 4

| Toner particle No. | Liquid dispersion preparation step: Dispersion stabilizer | pH | pH adjustment step: pH adjuster | Adjusted pH | pH adjustment temperature (° C.) | Resin particle addition step: Resin particle No. | Resin pKa |
|---|---|---|---|---|---|---|---|
| 1 | Calcium phosphate | 6.0 | KOH | 9.0 | 65 | 1 | 7.3 |
| 2 | Calcium phosphate | 6.0 | KOH | 9.0 | 75 | 1 | 7.3 |
| 3 | Calcium phosphate | 6.0 | KOH | 9.0 | 60 | 1 | 7.3 |
| 4 | Calcium phosphate | 6.0 | KOH | 9.0 | 75 | 2 | 7.3 |
| 5 | Calcium phosphate | 6.0 | KOH | 9.0 | 60 | 2 | 7.3 |
| 6 | Calcium phosphate | 6.0 | KOH | 9.0 | 65 | 3 | 7.3 |
| 7 | Calcium phosphate | 6.0 | KOH | 9.0 | 60 | 4 | −0.6 |
| 8 | Calcium phosphate | 6.0 | KOH | 9.0 | 60 | 5 | −0.6 |
| 9 | Calcium phosphate | 6.0 | KOH | 9.0 | 60 | 5 | −0.6 |
| 10 | Calcium phosphate | 6.0 | KOH | 9.0 | 55 | 5 | −0.6 |
| 11 | Calcium phosphate | 6.0 | KOH | 9.0 | 60 | 5 | −0.6 |
| 12 | Calcium phosphate | 6.0 | KOH | 9.0 | 70 | 6 | −0.6 |
| 13 | Calcium phosphate | 6.0 | KOH | 9.0 | 60 | 6 | 6.5 |
| 14 | Calcium phosphate | 6.0 | KOH | 9.0 | 60 | 7 | 8.9 |
| 15 | Calcium phosphate | 6.0 | KOH | 9.0 | 60 | 8 | 8.9 |
| 16 | Calcium phosphate | 6.0 | KOH | — | — | — | — |
| 17 | Calcium phosphate | 6.0 | KOH | 9.0 | 50 | 5 | −0.6 |
| 18 | Calcium phosphate | 6.0 | KOH | 9.0 | 70 | 5 | −0.6 |
| 19 | Calcium phosphate | 6.0 | KOH | 9.0 | 60 | 9 | −0.6 |
| 20 | Calcium phosphate | 6.0 | KOH | 9.0 | 60 | 10 | −0.6 |
| 21 | Calcium phosphate | 6.0 | KOH | 7.3 | 55 | 11 | 5.5 |

| Toner particle No. | Resin particle addition step: Solids parts (mass parts) | Addition temperature (° C.) | Attachment step: Attachment temperature (° C.) | Attachment time (h) | pH during attachment | pH − pKa |
|---|---|---|---|---|---|---|
| 1 | 0.5 | 65 | 65 | 1 | 9.0 | 1.7 |
| 2 | 0.5 | 75 | 75 | 1 | 9.0 | 1.7 |
| 3 | 0.5 | 60 | 60 | 0.5 | 9.0 | 1.7 |
| 4 | 0.5 | 75 | 75 | 1 | 9.0 | 1.7 |
| 5 | 0.5 | 60 | 60 | 0.5 | 9.0 | 1.7 |
| 6 | 1.3 | 65 | 65 | 1 | 9.0 | 1.7 |
| 7 | 0.5 | 60 | 60 | 1 | 9.0 | 9.6 |
| 8 | 1.3 | 60 | 60 | 0.5 | 9.0 | 9.6 |
| 9 | 1.3 | 60 | 60 | 1 | 9.0 | 9.6 |
| 10 | 1.3 | 55 | 55 | 0.5 | 9.0 | 9.6 |
| 11 | 2.3 | 60 | 60 | 0.5 | 9.0 | 9.6 |
| 12 | 1.3 | 70 | 70 | 1 | 9.0 | 9.6 |
| 13 | 0.5 | 65 | 65 | 1 | 9.0 | 2.5 |
| 14 | 0.5 | 65 | 65 | 1 | 9.0 | 1.0 |
| 15 | 0.5 | 65 | 65 | 1 | 9.0 | 0.1 |
| 16 | — | — | — | — | — | — |
| 17 | 1.3 | 50 | 50 | 0.5 | 9.0 | 9.6 |
| 18 | 1.3 | 70 | 70 | 1 | 9.0 | 9.6 |
| 19 | 1.8 | 60 | 60 | 0.5 | 9.0 | 9.6 |
| 20 | 0.4 | 60 | 60 | 0.5 | 9.0 | 9.6 |
| 21 | 0.5 | 55 | 55 | 1 | 7.3 | 1.8 |

Example 1

The inorganic fine particles A shown, in Table 5 were added to the resulting Toner particle 1 (100 parts), followed by 0.5 parts of an external additive consisting of silica fine powder with a number-average particle diameter (D1) of the primary particles of 10 nm and a BET specific surface area of 125 $m^2/g$ that had been surface treated with hexamethyldisilazane and silicone oil. These materials were mixed for 5 minutes at 3600 $s^{-1}$ in an FM mixer (Nippon Coke & Engineering Co., Ltd.) to obtain a Toner 1. The formulation and physical properties of the Toner are as described in Table 5.

TABLE 5

| Example No. | Toner No. | Toner particle No. | Length of protruded part (D): nm | Height of protruded part (D): nm | H/D | Average abundance of resin particle: % | Variation coefficient of resin particle | Inorganic fine particle A Type | Inorganic fine particle A Parts added | External addition rotation ($s^{-1}$) | External addition time (min) | Attached amount of inorganic fine particle A area % |
|---|---|---|---|---|---|---|---|---|---|---|---|---|
| 1 | 1 | 1 | 124 | 78 | 0.63 | 19 | 0.6 | A-1 | 0.5 | 3600 | 5 | 2.1 |
| 2 | 2 | 2 | 120 | 65 | 0.54 | 18 | 0.7 | A-1 | 0.5 | 3600 | 5 | 2.6 |
| 3 | 3 | 3 | 127 | 98 | 0.77 | 20 | 0.8 | A-1 | 0.5 | 3600 | 5 | 1.6 |
| 4 | 4 | 3 | 127 | 98 | 0.77 | 20 | 0.8 | A-2 | 0.5 | 3600 | 5 | 2.3 |
| 5 | 5 | 3 | 127 | 98 | 0.77 | 20 | 0.8 | A-3 | 0.5 | 3600 | 5 | 0.6 |
| 6 | 6 | 4 | 67 | 35 | 0.52 | 29 | 0.7 | A-1 | 0.5 | 3600 | 5 | 3.1 |
| 7 | 7 | 4 | 67 | 35 | 0.52 | 29 | 0.7 | A-4 | 0.5 | 3600 | 5 | 1.6 |
| 8 | 8 | 5 | 68 | 50 | 0.74 | 30 | 0.8 | A-1 | 0.5 | 3600 | 5 | 2.7 |
| 9 | 9 | 5 | 68 | 50 | 0.74 | 30 | 0.8 | A-5 | 0.5 | 3600 | 5 | 0.3 |
| 10 | 10 | 6 | 205 | 130 | 0.63 | 24 | 1.2 | A-1 | 0.5 | 3600 | 5 | 1.7 |
| 11 | 11 | 7 | 120 | 71 | 0.59 | 25 | 0.3 | A-1 | 0.5 | 3600 | 5 | 2.4 |
| 12 | 12 | 8 | 244 | 178 | 0.73 | 32 | 0.2 | A-1 | 0.5 | 3600 | 5 | 1.0 |
| 13 | 13 | 8 | 244 | 178 | 0.73 | 32 | 0.2 | A-1 | 3.0 | 3600 | 3 | 3.4 |
| 14 | 14 | 9 | 238 | 124 | 0.52 | 29 | 0.1 | A-1 | 0.5 | 3600 | 5 | 1.0 |
| 15 | 15 | 10 | 249 | 200 | 0.80 | 33 | 0.2 | A-1 | 0.5 | 3600 | 5 | 0.3 |
| 16 | 16 | 10 | 249 | 200 | 0.80 | 33 | 0.2 | A-1 | 5.0 | 3600 | 3 | 3.5 |
| 17 | 17 | 10 | 249 | 200 | 0.80 | 33 | 0.2 | A-6 | 0.5 | 3600 | 3 | 0.3 |
| 18 | 18 | 11 | 254 | 152 | 0.60 | 48 | 0.2 | A-1 | 0.5 | 3600 | 5 | 1.0 |
| 19 | 19 | 12 | 275 | 141 | 0.51 | 48 | 0.1 | A-1 | 0.5 | 3600 | 5 | 1.1 |
| 20 | 20 | 13 | 119 | 64 | 0.54 | 20 | 0.7 | A-1 | 0.5 | 3600 | 5 | 0.7 |
| 21 | 21 | 14 | 121 | 65 | 0.54 | 18 | 0.6 | A-1 | 0.5 | 3600 | 5 | 0.8 |
| 22 | 22 | 15 | 128 | 68 | 0.53 | 19 | 0.5 | A-1 | 0.5 | 3600 | 5 | 0.6 |
| Comparative 1 | 23 | 16 | — | — | — | — | — | A-1 | 0.5 | 3600 | 5 | 0.7 |
| Comparative 2 | 24 | 17 | 230 | 105 | 0.46 | 30 | 0.2 | A-1 | 0.5 | 3600 | 5 | 0.7 |
| Comparative 3 | 25 | 18 | 250 | 220 | 0.88 | 33 | 0.3 | A-1 | 0.5 | 3600 | 5 | 0.1 |
| Comparative 4 | 26 | 19 | 310 | 240 | 0.77 | 38 | 0.2 | A-1 | 0.5 | 3600 | 5 | 0.3 |
| Comparative 5 | 27 | 20 | 39 | 24 | 0.62 | 23 | 0.2 | A-1 | 0.5 | 3600 | 5 | 4.6 |
| Comparative 6 | 28 | 21 | 205 | 20 | 0.10 | 18 | 0.3 | A-1 | 0.5 | 3600 | 5 | 5.2 |
| Comparative 7 | 29 | 8 | 244 | 178 | 0.73 | 32 | 0.2 | A-7 | 0.5 | 3600 | 20 | 0.0 |
| Comparative 8 | 30 | 4 | 67 | 35 | 0.52 | 29 | 0.7 | A-8 | 0.5 | 3600 | 5 | 0.0 |
| Comparative 9 | 31 | 4 | 67 | 35 | 0.52 | 29 | 0.7 | A-9 | 0.5 | 3600 | 5 | 3.8 |

(Evaluation Tests)

1. Evaluation Method 1

For the evaluation, a Canon Inc. LBP-5050 laser beam printer was modified to give the cleaning blade an abutting linear pressure of 0.6 N/cm and an abutting angle of 23°. A4 Xerox 4200 (Xerox Corporation, 75 $g/m^3$) ordinary paper was used as the evaluation paper. With a conventional spherical toner, the abutting linear pressure is set to 1.0 N/cm or more, so the evaluation was performed under severe conditions with respect to the cleaning performance.

The cleaning performance was evaluated in a low-temperature, low-humidity environment because tracking of the photoreceptor drum decreases as the hardness of the cleaning blade increases. Fogging and image density stability were evaluated in a high-temperature, high-humidity (HH) environment because the toner is likely to deteriorate from heat and humidity.

(Toner Cleaning Performance)

A durability test was performed in which 5000 copies of a ruled line image were output continuously at a print percentage of 5% in a low-temperature, low humidity environment (10° C./14% RH). Gleaning performance was evaluated by confirming the presence or absence of vertical streaks and the like on the paper and photoreceptor drum visually on every 1000th copy. Ranks A to C are considered acceptable.

A: No faulty cleaning observed on the paper or photoreceptor drum

B: No faulty cleaning observed on the paper, but faulty cleaning observed on the photoreceptor drum after 4000 copies C: No faulty cleaning observed on the paper, but faulty cleaning observed on the photoreceptor drum after 2000 copies D: Faulty cleaning observed on the paper (Evaluation of Image Density)

A developing unit with a cartridge inserted therein was left standing for 24 hours in a high-temperature, high-humidity environment (HH) (30° C., 85% RH), and evaluated. One copy of a full-page solid image was output, and the density of the image was measured. The image density was measured with a color reflection densitometer (X-RITE 404, X-Rite Inc.).

An initial image was output, and the image density of that image given as the initial image density. A durability test was then performed in which 5000 copies of a ruled line image were output continuously with a print percentage of 5%, one copy of a full-page solid image was output, and the density of the image was measured and evaluated in the same way. The difference between the image density in this case and the initial image density was evaluated and ranked as follows. Ranks A to C are considered acceptable.

A: Image density difference is less than 0.10

B: Image density difference is from 0.10 to less than 0.20

C: Image density difference is from 0.20 to less than 0.30

D: Image density difference is 0.30 or more.

(Evaluation of Fogging in High-Temperature, High-Humidity Environment)

Durability was evaluated by methods similar to those used to evaluate image density, by performing a durability test in which in which 5000 copies of a ruled line image were output continuously with a print percentage of 5%, after which a full-page white image was output, and the initial fogging concentration and the fogging concentration on the paper after 5000 copies were measured.

The initial reflectivity (%) and the reflectivity of the full-page white image after the durability test were measured at points with a Reflectometer Model TC-6DS (Tokyo Denshoku Co., Ltd.), and the averages were calculated. Fogging was evaluated using a value (%) obtained by subtracting the resulting average reflectivity value from the reflectivity (%) of unused paper (standard paper) measured in the same way. The fogging evaluation results were ranked as follows. Ranks A to C are considered acceptable.

A: Fogging density is less than 1.0%

B: Fogging density is from 1.0% to less than 2.0%

C: Fogging density is from 2.0% to less than 3.0%

D: Fogging density is 3.0% or more

Toner 1 was evaluated by these methods, with the results shown in Table 6.

Examples 2 to 22

Toners 2 to 22 were obtained as in Example 1, but with the formulations shown in Table 5. The physical properties of the toners are as shown in Table 5.

These were then evaluated as in Example 1 with the results shown in Table 6.

Comparative Example 1

Toner 23 was obtained as in Example 1, but with the formulation shown in Table 5. It was also evaluated as in Example 1, with the results shown in Table 6. Cleaning performance tended to be poor due to the absence of resin particles on the surface of the toner base particle, Comparative Example 2

Toner 24 was obtained as in Example 1, but with the formulation shown in Table 5, and was evaluated as in Example 1 with the results shown in Table 6. Cleaning performance tended to be poor because the ratio of height to long-side length of the protruded portions originating in the resin particles on the surface of the toner base particle was too low.

Comparative Example 3

Toner 25 was obtained in Example 1, but with the formulation shown in Table 5, and was evaluated as in Example 1 with the results shown in Table 6. Cleaning performance tended to be poor because the ratio of height to long-side length of the protruded portions originating in the resin particles on the surface of the toner base particle was too high.

Comparative Example 4

Toner 26 was obtained as in Example 1, but with the formulation shown in Table 5, and was evaluated as in Example 1 with the results shown in Table 6. Cleaning performance tended to be poor due to the large size of the resin particles on the surface of the toner base particle.

Comparative Example 5

Toner 27 was obtained as in Example 1, but with the formulation shown in Table 5, and was evaluated as in Example 1 with the results shown in Table 6. Cleaning performance tended to be poor due to the small size of the resin particles on the surface of the toner base particle.

Comparative Example 6

100 mass parts of the obtained toner particle 21 were placed in an FM mixer (Nippon Coke & Engineering Co., Ltd.), the rotating speed was set at 4000 $s^{-1}$, and the particles were processed for 30 minutes to press the resin particles onto the surface of the toner base particle. Toner 28 was then obtained as in Example 1, but with the formulation shown in Table 5, and was evaluated as in Example 1 with the results shown in Table 6. Because the resin particles were, pressed onto the surface of the toner base particle, the protruded portions were small despite the large diameter of the resin particles, and cleaning performance tended to be poor due to the greater amount of movement by the external additive with a specific shape according to polycarbonate thin film attachment measurement.

Comparative Example 7

Toner 29 was obtained as in Example 1, but with the formulation shown in Table 5, and evaluated as in Example 1 with the results shown in Table 6. Cleaning performances tended to be pool because the Feret diameter of the external additive was small relative to the height of the protruded portions originating in the resin particles on the surface of the toner base particle, and due to the greater amount of movement by the additive with, a specific shape according to polycarbonate thin film attachment measurement.

Comparative Example 8

Toner 30 was obtained as in Example 1, but with the formulation shown in Table 5, and evaluated as in Example 1 with the results shown in Table 6. Cleaning performance tended to be poor due to the large compactness of the inorganic fine particle A and the greater amount of movement by the additive with a specific shape according to polycarbonate thin film attachment measurement.

Comparative Example 9

Toner 31 was obtained as in Example 1, but with the formulation shown in Table 5, and evaluated as in Example 1 with the results shown in Table 6. Cleaning performance tended to be poor due to the small compactness of the inorganic fins particle A and the greater amount of movement by the additive with a specific shape according to polycarbonate thin film attachment measurement.

TABLE 6

| Example No. | Toner No. | CLN performance | HH initial image density | HH image stability | HH initial fogging | HH fogging after durability |
|---|---|---|---|---|---|---|
| 1 | 1 | A | 1.45 | A(0.03) | A(0.3) | A(0.5) |
| 2 | 2 | A | 1.43 | A(0.05) | A(0.4) | A(0.6) |
| 3 | 3 | A | 1.42 | A(0.04) | A(0.8) | B(1.1) |
| 4 | 4 | A | 1.43 | B(0.12) | A(0.9) | B(1.3) |
| 5 | 5 | A | 1.41 | A(0.04) | A(0.2) | A(0.8) |
| 6 | 6 | A | 1.44 | B(0.11) | A(0.4) | A(0.7) |
| 7 | 7 | B (after 5000 copies) | 1.44 | A(0.06) | A(0.6) | A(0.8) |
| 8 | 8 | A | 1.43 | B(0.13) | A(0.5) | A(0.8) |
| 9 | 9 | B (after 5000 copies) | 1.42 | A(0.07) | A(0.7) | A(0.9) |
| 10 | 10 | A | 1.41 | C(0.23) | A(0.9) | B(1.3) |
| 11 | 11 | A | 1.38 | A(0.08) | B(1.2) | C(2.1) |
| 12 | 12 | B (after 5000 copies) | 1.39 | B(0.15) | B(1.1) | C(2.3) |
| 13 | 13 | A | 1.28 | C(0.22) | C(2.1) | C(2.3) |
| 14 | 14 | A | 1.35 | B(0.18) | B(1.2) | C(2.5) |
| 15 | 15 | B (after 5000 copies) | 1.42 | A(0.09) | A(0.9) | C(2.4) |
| 16 | 16 | B (after 5000 copies) | 1.25 | C(0.25) | C(2.1) | C(2.3) |
| 17 | 17 | B (after 5000 copies) | 1.24 | C(0.28) | C(2.3) | C(2.7) |
| 18 | 18 | A | 1.23 | C(0.25) | A(0.9) | B(1.3) |
| 19 | 19 | B (after 5000 copies) | 1.22 | C(0.29) | A(0.7) | B(1.2) |
| 20 | 20 | A | 1.43 | A(0.04) | A(0.3) | A(0.5) |
| 21 | 21 | A | 1.44 | A(0.06) | A(0.2) | A(0.4) |
| 22 | 22 | A | 1.42 | A(0.08) | A(0.4) | A(0.6) |
| Comparative 1 | 23 | D (after 1000 copies) | 1.43 | A(0.05) | B(1.2) | C(2.7) |
| Comparative 2 | 24 | D (after 3000 copies) | 1.42 | A(0.09) | B(1.2) | C(2.3) |
| Comparative 3 | 25 | D (after 2000 copies) | 1.38 | B(0.14) | C(2.2) | D(3.1) |
| Comparative 4 | 26 | D (after 3000 copies) | 1.34 | B(0.18) | C(2.3) | D(3.2) |
| Comparative 5 | 27 | D (after 2000 copies) | 1.36 | C(0.24) | A(0.5) | C(2.5) |
| Comparative 6 | 28 | D (after 2000 copies) | 1.26 | C(0.25) | C(2.7) | D(4.2) |
| Comparative 7 | 29 | D (after 2000 copies) | 1.35 | B(0.15) | C(2.1) | C(2.4) |
| Comparative 8 | 30 | D (after 4000 copies) | 1.44 | C(0.23) | A(0.7) | B(1.3) |
| Comparative 9 | 31 | D (after 5000 copies) | 1.28 | D(0.31) | C(2.2) | D(3.9) |

In the evaluation of cleaning performance (CLN), the numbers in brackets indicate the number of copies at which faulty cleaning occurred on the photoreceptor drum.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-019478, filed Feb. 4, 2016, which is hereby incorporated by reference herein in its entirety.

What is claimed is:

1. A toner comprising:

a toner particle containing a toner base particle containing a binder resin and a colorant, and a resin particle fixed to a surface of the toner base particle; and an inorganic fine particle A, wherein the surface of the toner particle has protruded portions originating in the resin particle, an average length (D) of long sides of the protruded portions is from 50 nm to 300 nm, an average height (H) of the protruded portions is from 25 nm to 250 nm, a relationship between the average long-side length and the average height of the protruded portions satisfies the following formula (1), and an average value of a compactness of the inorganic fine particle A observed under scanning electron microscope (SEM) as represented by formula (2) below is from 0.40 to 0.80, and the attachment rate of the inorganic fine particles A with a compactness of from 0.40 to 0.80 is from 0.1% to 5.0% by area according to polycarbonate thin film attachment measurement of the toner:

$$0.50D \leq H \leq 0.80D \quad \text{Formula (1)}$$

Compactness=area of inorganic fine particle/area of region enclosed by envelope of inorganic fine particle Formula (2).

2. The toner according to claim 1, wherein a median diameter (D50) of the resin particles as determined by a laser scattering particle size distribution analysis is from 50 nm to 300 nm.

3. The toner according to claim 1, wherein an average minimum Feret diameter of the inorganic fine particles A as observed by scanning electron microscopy (SEM) is from 50 nm to 500 nm.

4. The toner according to claim 1, wherein in four regions defined as follows in a backscattered electron image of a toner particle taken with a scanning electron microscope, an average abundance of the resin particles in each region is from 5% to 40% by area, and a coefficient of variation of the number of resin particles as represented by Formula (3) below is 1.5 or less:

Definition of regions: In a backscattered electron image of a toner particle, a chord giving the maximum length is given as line segment A, and two straight lines parallel to and 1.5 μm distant from the line segment A are given as line B and line C. A straight line passing through the center point of line segment A at a right angle is given as line D, and two straight lines parallel to and 1.5 μm distant from line D are given as line E and line F. Four square areas each having 1.5 μm sides formed by the line segment A and the lines B, C, D, E and F are defined as the four regions;

Coefficient of variation=(standard deviation of number of particles/average number of particles) Formula (3).

5. The toner according to claim 1, wherein the resin particles contain a resin having ionic functional groups and a pKa (acid dissociation constant) of from 6.0 to 9.0.

* * * * *